US009835318B2

(12) United States Patent
Ando et al.

(10) Patent No.: US 9,835,318 B2
(45) Date of Patent: Dec. 5, 2017

(54) LUMINAIRE

(71) Applicant: PANASONIC INTELLECTUAL PROPERTY MANAGEMENT CO., LTD., Osaka (JP)

(72) Inventors: Tamotsu Ando, Osaka (JP); Tatsumi Setomoto, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 232 days.

(21) Appl. No.: 14/819,503

(22) Filed: Aug. 6, 2015

(65) Prior Publication Data

US 2016/0069551 A1 Mar. 10, 2016

(30) Foreign Application Priority Data

Sep. 5, 2014 (JP) ..... 2014-181664

(51) Int. Cl.

| | |
|---|---|
| ***F21V 23/00*** | (2015.01) |
| ***F21V 23/02*** | (2006.01) |
| ***H05B 37/02*** | (2006.01) |
| ***F21V 23/04*** | (2006.01) |

(52) U.S. Cl.

CPC ..... *F21V 23/023* (2013.01); *F21V 23/0435* (2013.01); *H05B 37/0272* (2013.01)

(58) Field of Classification Search

CPC F21V 23/023; F21V 23/0435; H05B 37/0272
See application file for complete search history.

(56) References Cited

U.S. PATENT DOCUMENTS

| | | | | |
|---|---|---|---|---|
| 6,636,005 | B2 * | 10/2003 | Wacyk | H05B 37/0272 315/149 |
| 9,565,744 | B2 * | 2/2017 | Lai | H05B 37/0272 |
| 2012/0268343 | A1 * | 10/2012 | Yanagi | H01Q 1/526 343/872 |
| 2013/0181607 | A1 | 7/2013 | Yotsumoto et al. | |
| 2013/0278469 | A1 * | 10/2013 | Yonezawa | H01Q 1/002 343/702 |
| 2016/0223153 | A1 * | 8/2016 | Van Dijk | F21S 8/03 |

FOREIGN PATENT DOCUMENTS

| | | |
|---|---|---|
| JP | 2002-289372 | 10/2002 |
| JP | 2006-093098 | 4/2006 |
| JP | 2006-108043 | 4/2006 |
| JP | 2007-227041 | 9/2007 |
| JP | 2002-343581 | 11/2009 |
| JP | 2009-290267 | 12/2009 |
| JP | 2009-290272 | 12/2009 |
| JP | 3180009 | 11/2012 |
| JP | 2013-033652 | 2/2013 |
| JP | 2013-145634 | 7/2013 |

* cited by examiner

*Primary Examiner* — Peggy Neils
(74) *Attorney, Agent, or Firm* — Greenblum & Bernstein, P.L.C.

(57) ABSTRACT

A luminaire is provided that includes a power circuit that supplies power to a light source, an antenna that at least one of transmits and receives a wireless signal, and a metal housing that contains the antenna and the power circuit. The metal housing has an opening, such that the antenna and the opening are arranged to cause a polarization plane of an electric wave most strongly radiated from the antenna, and a polarization plane of an electric wave most strongly radiated from the opening, to substantially coincide with each other.

18 Claims, 36 Drawing Sheets

| ANGLE BETWEEN LONG SIDE OF OPENING AND ANTENNA [°] | SCHEMATIC DIAGRAM |
|---|---|
| 90 |   |
| 75 |   |
| 45 |   |
| 15 |   |
| 5 |   |
| 0 |   |

FIG. 11

| | SHAPE OF OPENING | SWR | MAIN LOBE | | | SIDE LOBE [dB] |
|---|---|---|---|---|---|---|
| | | | STRENGTH [dB] | DIRECTION [°] | ANGLE WIDTH [°] | |
| (a) | 120 | 1.3 | 2.6 | 92 | 105.5 | -3.8 |
| (b) | 101 | 1.4 | 5.7 | 91 | 97.6 | -4.3 |
| (c) | 102 | 1.4 | 5.1 | 93 | 100.2 | -4.2 |
| (d) | 103 | 1.4 | 5.1 | 93 | 100.2 | -4.2 |
| (e) | 104 | 40.3 | -36.5 | 93 | 96.4 | -5.2 |
| (f) | 105 | 8.5 | -29.8 | 92 | 97.3 | -5.2 |
| (g) | 106 | 8.5 | -30.2 | 95 | 96.6 | -5 |

| FREQUENCY | | 2.4 GHz | |
|---|---|---|---|
| OPENING WIDTH OF OPENING | | 0.5 mm | 1.0 mm |
| RADIATION PATTERN | XZ PLANE | MAIN LOBE -23.4 dB (202.0°)  | MAIN LOBE -11.6 dB (209.0°)  |
| | YZ PLANE | MAIN LOBE -16.7 dB (104.4°)  | MAIN LOBE -30.5 dB (185.0°)  |
| | |   | |

LUMINAIRE

CROSS REFERENCE TO RELATED APPLICATION

This application claims the benefit of priority of Japanese Patent Application Number 2014-181664, filed Sep. 5, 2014, the entire content of which is hereby incorporated by reference.

BACKGROUND OF THE INVENTION

1. Field of the Invention

The present disclosure relates to a luminaire capable of wireless communication.

2. Description of the Related Art

Luminaires capable of wireless communication have been conventionally known. A luminaire capable of wireless communication includes an antenna for wireless communication, and performs processes according to wireless signals received by the antenna (for example, see Japanese Unexamined Patent Application Publication No. 2013-145634).

SUMMARY OF THE INVENTION

It is aesthetically desirable that the antenna included in the luminaire is unnoticeable in the state where the luminaire is installed. The antenna is therefore placed in the luminaire body of the luminaire or in a housing in which a power circuit is contained.

However, the luminaire body and the housing containing the power circuit are typically made of metal, for safety measures and the like. Such a metal housing blocks electric waves, which causes a problem in ensuring the communication function of the antenna.

The present disclosure accordingly has an object of providing a luminaire that ensures the communication function of wireless communication and also improves the communication quality.

To achieve the object stated above, a luminaire according to one aspect of the present disclosure includes: a power circuit that supplies power to a light source; an antenna that at least one of transmits and receives a wireless signal; and a metal housing that contains the antenna and the power circuit. The metal housing has an opening, and the antenna and the opening are arranged to cause a polarization plane of an electric wave most strongly radiated from the antenna and a polarization plane of an electric wave most strongly radiated from the opening to substantially coincide with each other.

This structure ensures the communication function of wireless communication and also improves the communication quality.

BRIEF DESCRIPTION OF DRAWINGS

The figures depict one or more implementations in accordance with the present teaching, by way of examples only, not by way of limitations. In the figures, like reference numerals refer to the same or similar elements.

FIG. 11 is a diagram illustrating the relationship between the shape of the opening group of the metal housing and the communication performance according to Embodiment 2 of the present disclosure;

DETAILED DESCRIPTION OF THE PREFERRED EMBODIMENTS

Figure 1:
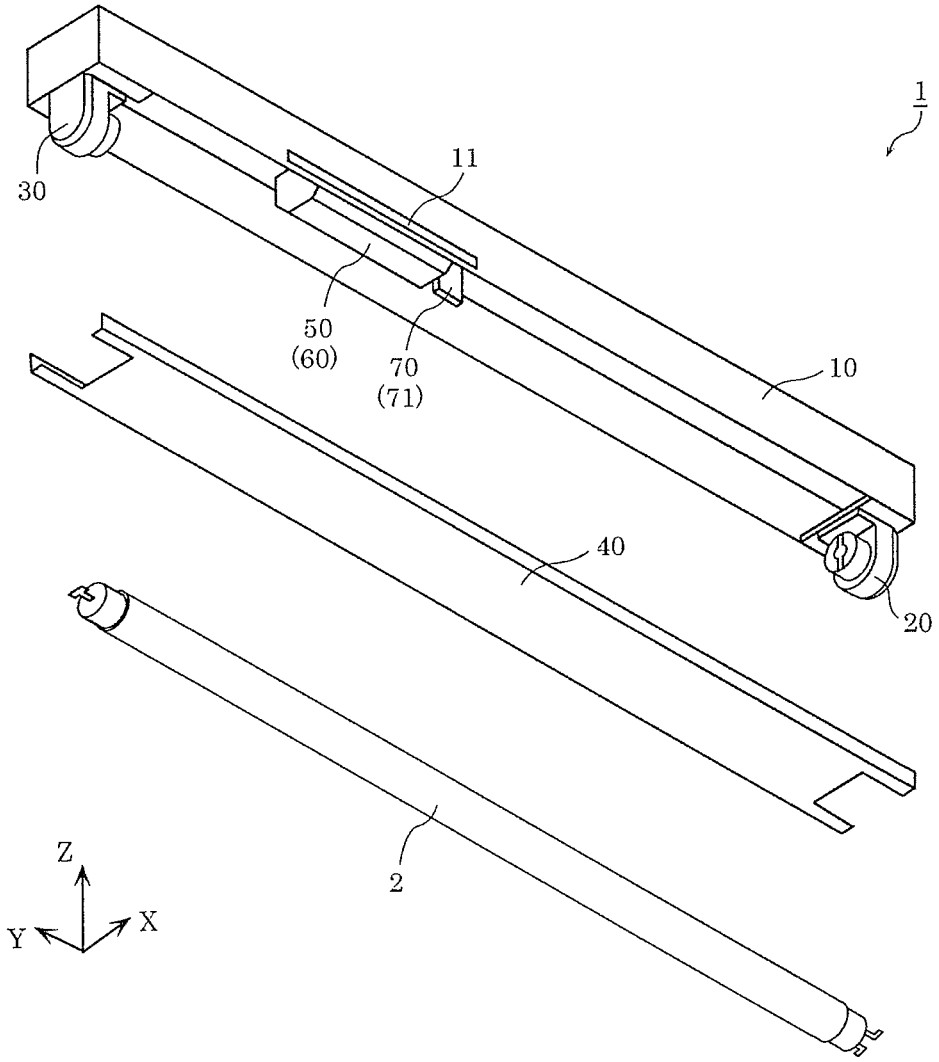
FIG. 1 is an exploded perspective view illustrating a luminaire according to Embodiment 1 of the present disclosure.

The following describes a luminaire according to each of the embodiments of the present disclosure in detail, with reference to drawings. Each of the embodiments described below shows a general or specific example. The numerical values, shapes, materials, structural elements, the arrangement and connection of the structural elements, etc. shown in the following embodiments are mere examples, and therefore do not limit the scope of the present disclosure. Of the structural elements in the following embodiments, structural elements not recited in any one of the independent claims representing superordinate concepts are described as optional structural elements.

Each of the drawings is a schematic diagram, and does not necessarily provide exact illustration. The same structural members are given the same reference signs in the drawings.

Embodiment 1

Luminaire

Figure 2:
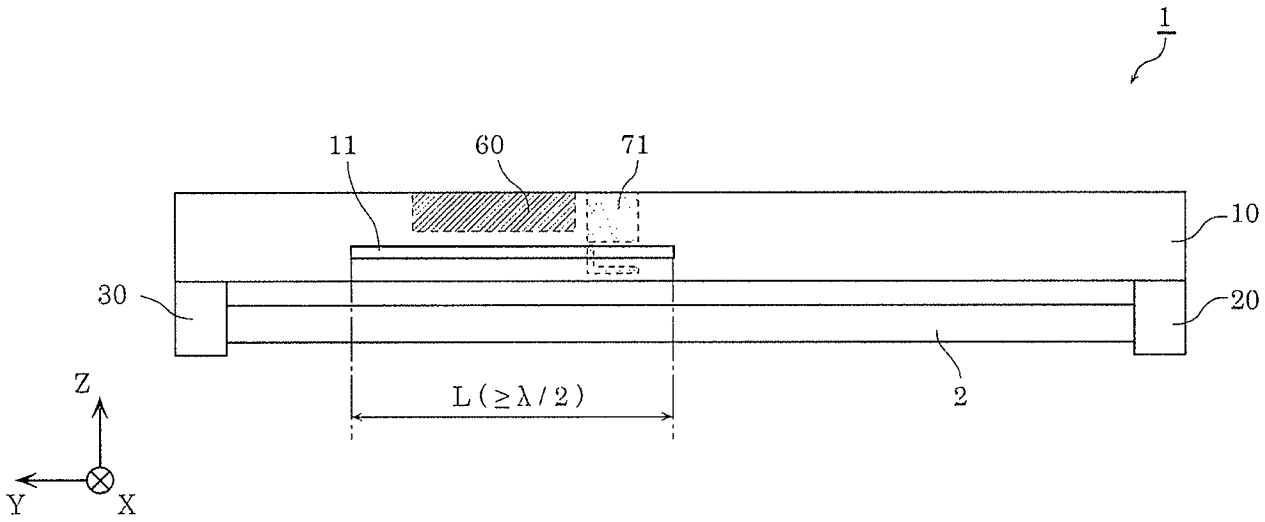
FIG. 2 is a side view illustrating the luminaire according to Embodiment 1 of the present disclosure.

An overview of a luminaire according to Embodiment 1 is described first, with reference to FIGS. 1 and 2. FIG. 1 is an exploded perspective view illustrating luminaire 1 according to this embodiment. FIG. 2 is a side view illustrating luminaire 1 according to this embodiment.

Luminaire 1 according to this embodiment is capable of wireless communication. In detail, luminaire 1 performs wireless communication with another apparatus such as a remote control or a mobile information terminal such as a smartphone or a tablet terminal. In more detail, luminaire 1 transmits a wireless signal to another apparatus, or receives a wireless signal from another apparatus. For example, in the case where luminaire 1 receives a wireless signal from another apparatus, luminaire 1 performs a process such as turning on the light, turning off the light, dimming, or toning based on the received wireless signal.

Luminaire 1 includes light source 2, luminaire body 10, feeding socket 20, non-feeding socket 30, reflector 40, circuit case 50, power circuit 60, and wireless module 70 including antenna 71, as illustrated in FIGS. 1 and 2.

Luminaire 1 has one surface (i.e. the surface opposite to reflector 40) of luminaire body 10 fixed to an installation surface such as a ceiling. Luminaire 1 is long, as illustrated in FIGS. 1 and 2. The X axis direction is the transverse direction of reflector 40 of luminaire 1, the Y axis direction is the longitudinal direction of reflector 40, and the Z axis direction is the direction perpendicular to reflector 40. Hereafter, "up" means the Z axis positive direction (toward the installation surface such as the ceiling) and "down" means the Z axis negative direction (the direction of light irradiation) in FIGS. 1 and 2.

Each structural member in luminaire 1 is described in detail below.

[Light Source]

Light source 2 is a light source for illumination including a light emitting module having a light emitting element, and emits predetermined light. Light source 2 is removably placed in luminaire body 10.

In this embodiment, light source 2 is a straight-tube light emitting diode (LED) lamp. The straight-tube LED lamp includes, for example, a long housing such as a glass bulb, an LED module placed in the housing, and a feeding base and non-feeding base provided at the ends of the housing.

The LED module is actually a chip-on-board (COB) light emitting module in which an LED chip is mounted directly on a board, though the LED module is not limited to this. For example, the LED module may be a light emitting module in which a surface-mount-device (SMD) LED element is used as a light emitting element. The SMD LED element is a packaged LED element obtained by mounting an LED chip in a cavity of a case made of resin and enclosing phosphor-containing resin in the cavity. The light emitting element included in light source 2 may be any other solid light emitting element, for example, a semiconductor light emitting element such as a semiconductor laser or an electroluminescence (EL) element such as an organic EL or inorganic EL element.

[Luminaire Body]

Luminaire body 10 is an example of a metal structure. Luminaire body 10 is formed by bending a plate member made of metal such as aluminum to have an opening on the lower side.

Luminaire body 10 is a container that contains circuit case 50 (power circuit 60) and wireless module 70 (antenna 71). In detail, luminaire body 10 is substantially a long rectangular parallelepiped, and has its open surface covered by reflector 40. Feeding socket 20 and non-feeding socket 30 are provided at the respective ends of luminaire body 10 so as to protrude downward below reflector 40.

In this embodiment, luminaire body 10 and reflector 40 constitute a metal housing that contains power circuit 60 and antenna 71.

Luminaire body 10 has opening 11. In this embodiment, only one opening 11 is formed in a side surface of luminaire body 10, as illustrated in FIG. 2.

Opening 11 is a slit opening. In detail, opening 11 is substantially rectangular in shape. Opening 11 is formed, for example, with its long side direction (Y axis direction) being parallel to the long side direction of luminaire body 10. The length (L in FIG. 2) of the long side of opening 11 is greater than or equal to substantially half ($\lambda/2$) the wavelength $\lambda$ corresponding to the wireless signal frequency.

The term "substantially half the wavelength" means that the length is essentially or approximately equal to the half wavelength. The term "substantially half the wavelength" may include the range of plus and minus several % (e.g. 5%) with respect to the half wavelength. For example, the length of the long side of opening 11 may be several % shorter than half ($\lambda/2$) the wavelength $\lambda$ corresponding to the wireless signal frequency. The same applies to other similar descriptions.

[Feeding Socket and Non-Feeding Socket]

Feeding socket 20 is a socket for feeding power to light source 2. Feeding socket 20 is formed, for example, by insert molding using a resin material and a pin receiving terminal made of metal.

A base pin (e.g. a pair of L-shaped pins) of a feeding base of light source 2 is inserted in feeding socket 20. The inserted base pin is in contact with the metal pin receiving terminal in feeding socket 20. For example, the pin receiving terminal is connected to power circuit 60 in circuit case 50. Power for lighting light source 2 can thus be fed to light source 2 via feeding socket 20.

Non-feeding socket 30 is a non-feeding socket for holding light source 2. Non-feeding socket 30 is formed, for example, by injection molding using a resin material. A base pin (e.g. a T-shaped pin) of a non-feeding base of light source 2 is inserted in non-feeding socket 30.

[Reflector]

Reflector 40 is an example of a metal structure. Reflector 40 is formed by processing a plate member made of metal, like luminaire body 10. For example, reflector 40 is painted white or milk white so that its lower surface has a reflection function. Although this embodiment describes an example where reflector 40 is separate from luminaire body 10, reflector 40 may be formed integrally with luminaire body 10.

[Circuit Case]

Circuit case 50 is a case that contains power circuit 60. Circuit case 50 is formed, for example, by bending a plate member made of metal such as aluminum.

For example, circuit case 50 has a through hole through which a lead wire (not illustrated) is inserted. The lead wire electrically connects power circuit 60 and antenna 71.

Circuit case 50 may contain not only power circuit 60 but also antenna 71, as in Embodiment 3 described later. Detailed description will be given in Embodiment 3.

[Power Circuit]

Power circuit 60 is a circuit (lighting circuit) for supplying power to light source 2. In detail, power circuit 60 converts AC power supplied from system power or the like via a cable (not illustrated) into DC power and supplies the power to light source 2.

Power circuit 60 is formed, for example, on a printed wiring board. In detail, power circuit 60 includes a diode bridge rectifier circuit for converting AC power into DC power and a DC-DC converter. Power circuit 60 may be realized as one integrated circuit (IC) having the same functions as a rectifier circuit and a DC-DC converter.

[Wireless Module and Antenna]

Figure 3:
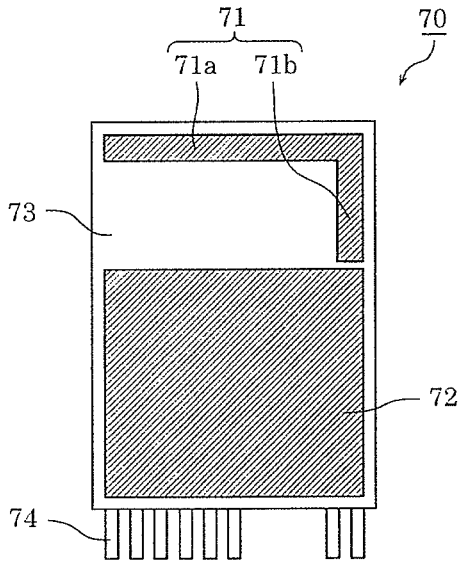
FIG. 3 is a diagram illustrating a wireless module including an antenna according to Embodiment 1 of the present disclosure.

FIG. 3 is a diagram illustrating wireless module 70 including antenna 71 according to this embodiment.

Wireless module 70 includes antenna 71, wireless control circuit 72, printed wiring board 73, and connector 74, as illustrated in FIG. 3.

Antenna 71 is a pattern antenna for transmitting or receiving a wireless signal. In other words, antenna 71 is a conductive pattern formed on printed wiring board 73, as illustrated in FIG. 3. Providing antenna 71 on printed wiring board 73 as a pattern antenna enables a reduction in size of antenna 71.

Note that antenna 71 is any antenna that performs at least one of transmission and reception of a wireless signal, and is not limited to a pattern antenna. For example, antenna 71 may be a chip antenna.

In this embodiment, antenna 71 is a substantially L-shaped pattern antenna. As illustrated in FIG. 3, antenna 71 has tip portion 71*a* and root portion 71*b*. Tip portion 71*a* is a part on the tip side of antenna 71. Root portion 71*b* is a part on the wireless control circuit 72 side of antenna 71. Tip portion 71*a* and root portion 71*b* are substantially orthogonal to each other.

Although antenna 71 is not limited to be substantially L-shaped but may be linear or the like in shape, substantially L-shaped antenna 71 enables a reduction in size of wireless module 70.

In this embodiment, the frequency band of the wireless signal transmitted or received by antenna 71 is the ultra high frequency (UHF) band or the super high frequency (SHF) band.

Wireless control circuit 72 is an integrated circuit that controls the transmission or reception of the wireless signal by antenna 71. In this embodiment, wireless control circuit 72 obtains a predetermined command included in the wireless signal which antenna 71 has received from a remote control or the like. Wireless control circuit 72 controls power circuit 60 according to the obtained command. In detail, wireless control circuit 72 controls power circuit 60 to turn on or off light source 2.

In this embodiment, wireless control circuit 72 performs communication using ZigBee® which is one of the standards for wireless personal area networks (WPANs). The communication method of wireless control circuit 72 is, however, not limited to this, and may be Bluetooth® or a wireless local area network (LAN).

Printed wiring board 73 is a board on which antenna 71 and wireless control circuit 72 are mounted.

Connector 74 is a connector for connecting power circuit 60 and each of wireless control circuit 72 and antenna 71. For example, a receiving-side connector (not illustrated) to which connector 74 is connectable is provided in luminaire body 10. The receiving-side connector is electrically connected to power circuit 60 via a lead wire or the like. By connecting connector 74 to the receiving-side connector, wireless control circuit 72 can be electrically connected to power circuit 60.

Connecting connector 74 and the receiving-side connector allows the position of wireless module 70 in luminaire body 10 to be fixed. The positional relationship between antenna 71 and opening 11 can thus be determined, as described later.

Power circuit 60 and wireless control circuit 72 may be connected directly to each other via a lead wire.

Although power circuit 60 and the structure including antenna 71 and wireless control circuit 72 are provided on different boards in this embodiment, these components may be provided on one board. In this case, a shorter wire length contributes to more stable operation, and a smaller number of components contributes to lower cost.

[Positional Relationship Between Antenna and Opening]

Figure 4:
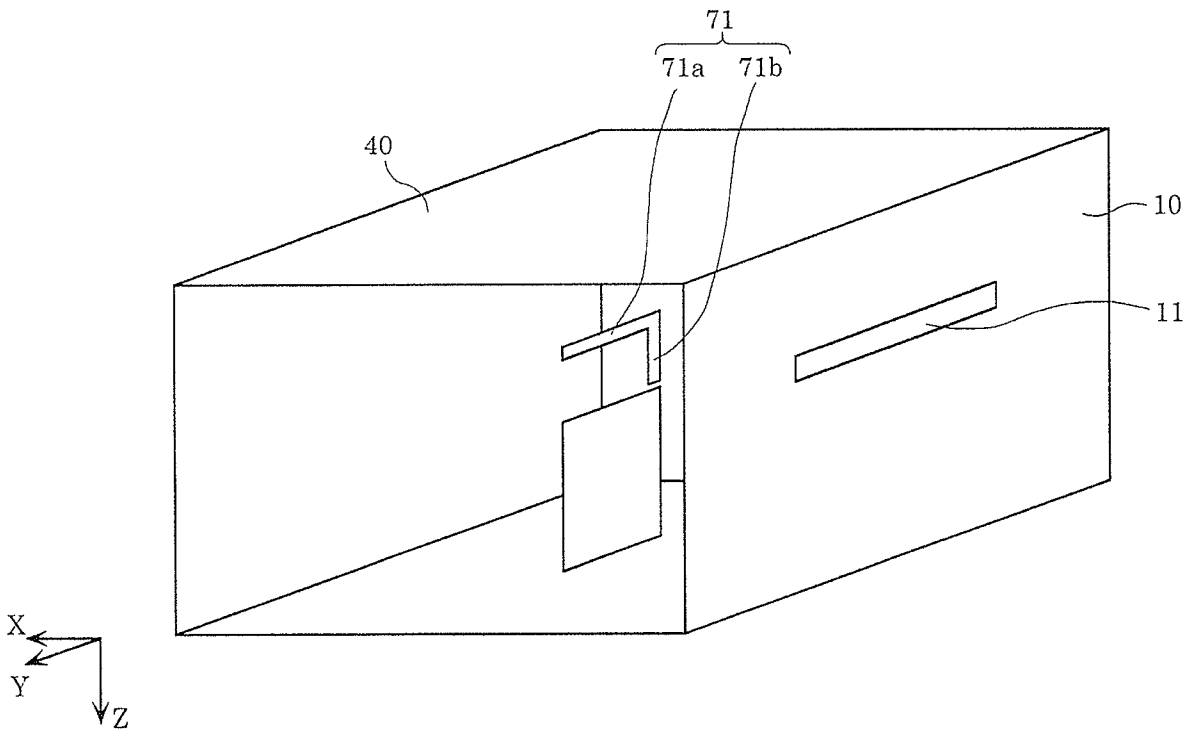
FIG. 4 is a diagram illustrating the positional relationship between an opening of the luminaire body and the antenna according to Embodiment 1 of the present disclosure.

The following describes the positional relationship between antenna 71 and opening 11 formed in luminaire body 10 according to this embodiment, with reference to FIG. 4.

FIG. 4 is a diagram illustrating the positional relationship between opening 11 of luminaire body 10 and antenna 71 according to this embodiment.

In this embodiment, luminaire body 10 is combined with reflector 40 to constitute a metal housing which is substantially a rectangular parallelepiped. The metal housing has opening 11 and contains antenna 71 inside, as illustrated in FIG. 4.

In this case, since antenna 71 in the metal housing and opening 11 are close to each other, antenna 71 and opening 11 are coupled to each other. As a result, an electric wave generated from antenna 71 causes a current to flow on the surface of the metal housing. In other words, opening 11 of the metal housing functions as a slot antenna. In the slot antenna, an electric field is generated in the short side direction of opening 11. Hence, in the example illustrated in FIG. 4, the polarization plane of the electric wave most strongly radiated from opening 11 is parallel to the short side direction of opening 11.

In this embodiment, antenna 71 and opening 11 are arranged so that the polarization plane of the electric wave most strongly radiated from antenna 71 and the polarization plane of the electric wave most strongly radiated from opening 11 substantially coincide with each other. In detail, antenna 71 is positioned so that the polarization plane of the electric wave most strongly radiated from antenna 71 is at an angle of at least ±15° with respect to the long side direction of opening 11.

The strength of the electric wave radiated from antenna 71 is described below, with reference to FIGS. 5A and 5B.

Figure 5A:
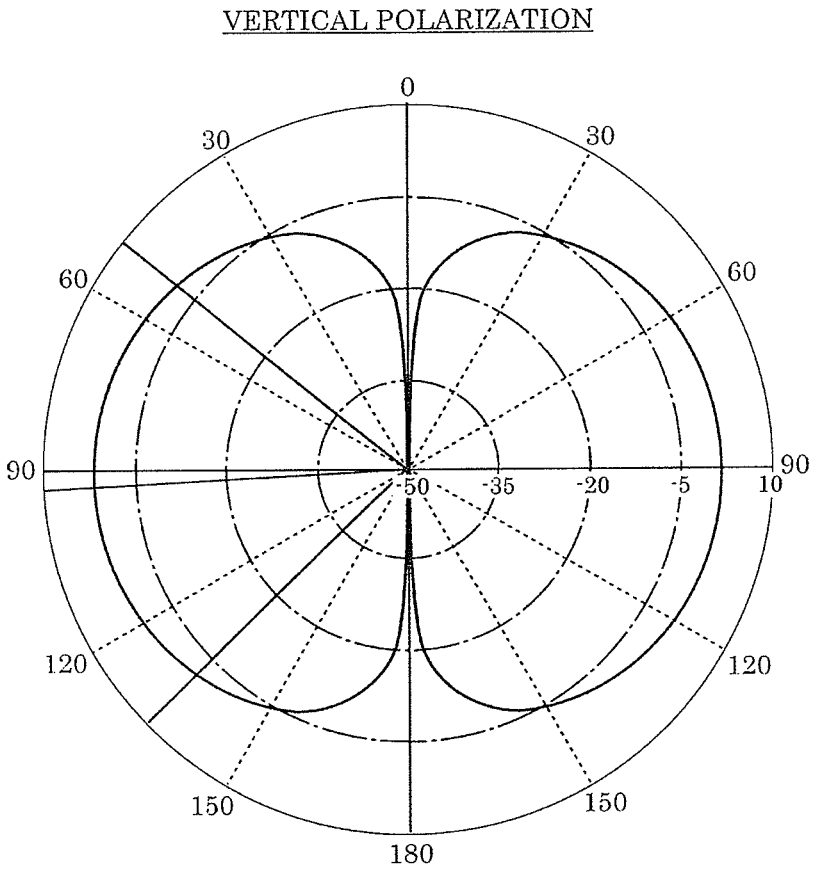
FIG. 5A is a diagram illustrating the strength of vertical polarization of the antenna according to Embodiment 1 of the present disclosure.
Figure 5B:
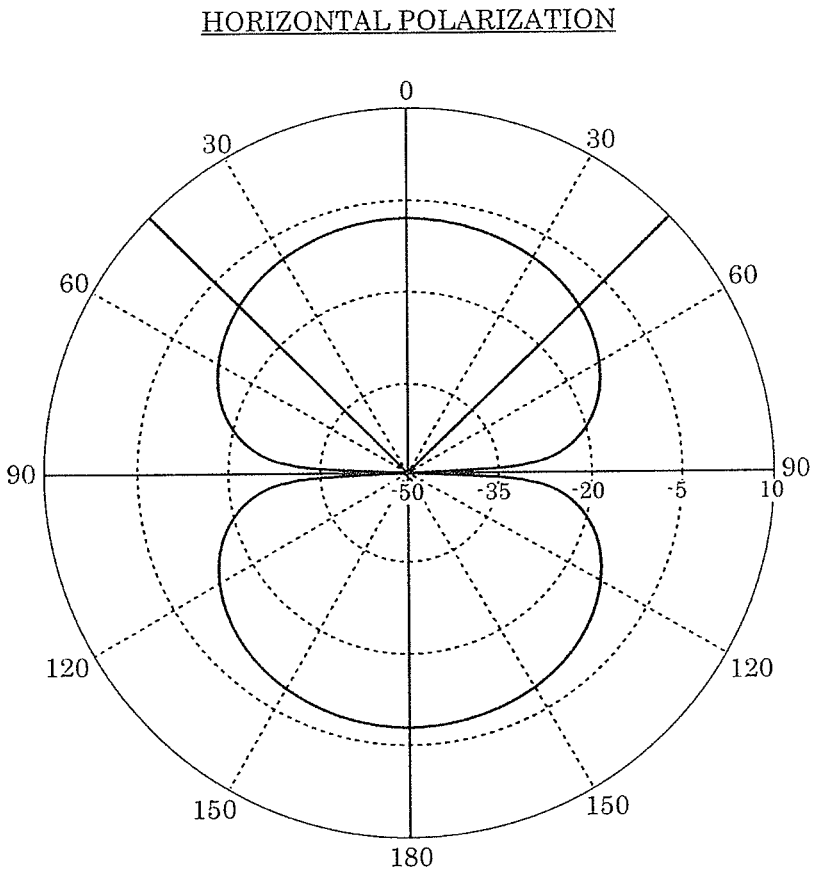
FIG. 5B is a diagram illustrating the strength of horizontal polarization of the antenna according to Embodiment 1 of the present disclosure.

FIGS. 5A and 5B are diagrams respectively illustrating the strengths of vertical polarization and horizontal polarization of antenna 71 according to this embodiment. The vertical polarization is the direction parallel to root portion 71*b* of antenna 71, and the horizontal polarization is the direction parallel to tip portion 71*a* of antenna 71.

As can be understood from the comparison of FIGS. 5A and 5B, the vertical polarization is stronger than the horizontal polarization. Though other polarizations are not illustrated, the polarization plane of the electric wave most strongly radiated from antenna 71 in this embodiment is the vertical polarization. In other words, the polarization plane of the electric wave most strongly radiated from antenna 71 is parallel to root portion 71*b*.

Accordingly, antenna 71 is positioned so that root portion 71*b* is perpendicular to the long side direction of opening 11, as illustrated in FIG. 4. As a result, the polarization plane (the vertical polarization illustrated in FIG. 5A) of the electric wave most strongly radiated from antenna 71 and the polarization plane (the short side direction of opening 11) of the electric wave most strongly radiated from opening 11 coincide with each other.

The positional relationship between opening 11 of the metal housing and antenna 71 and the maximum gain of the electric wave radiated from opening 11 are described below, with reference to FIGS. 6 to 8B.

Figure 6:
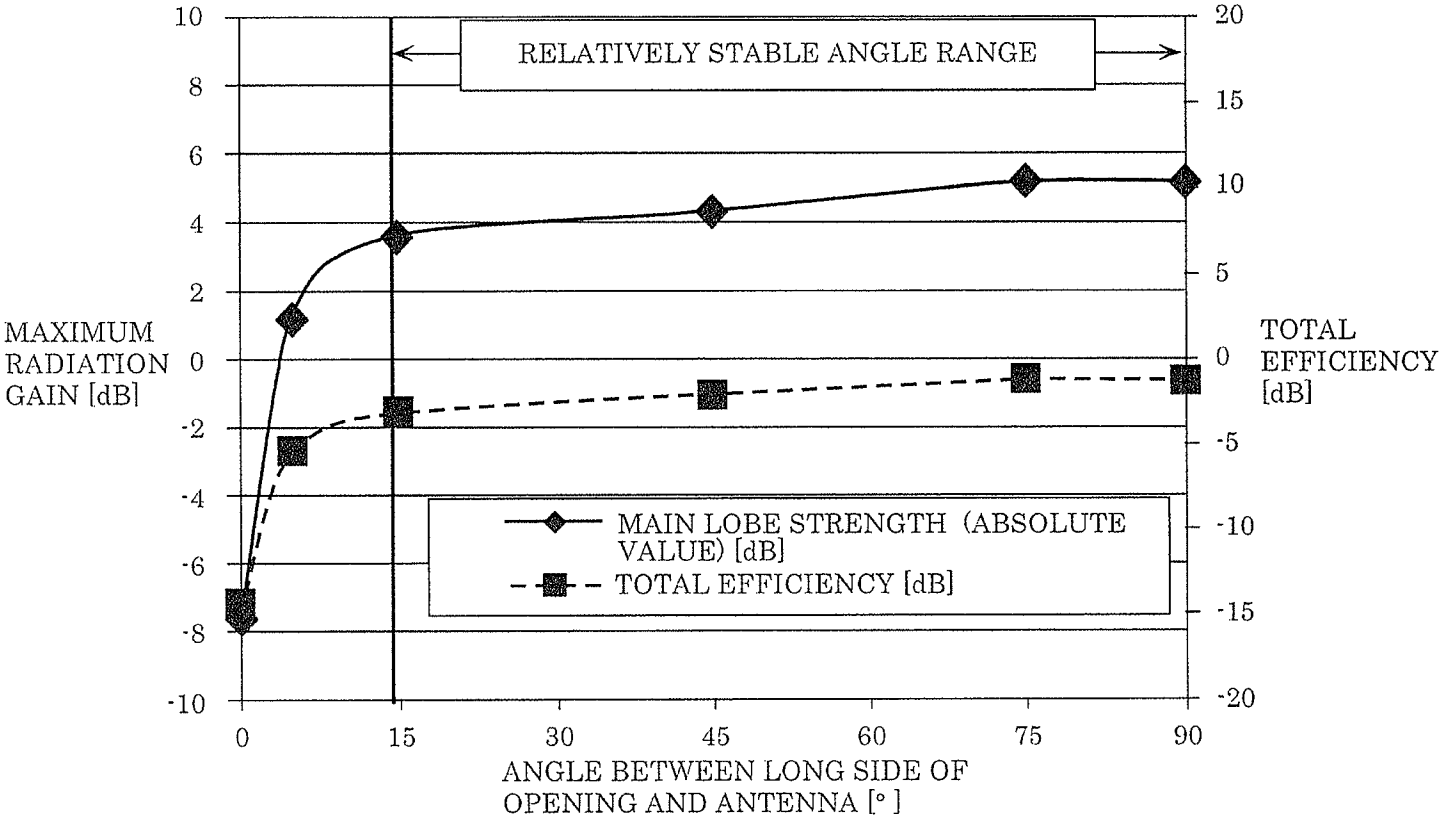
FIG. 6 is a diagram illustrating the strength of electric wave with respect to the positional relationship between the opening of the metal housing and the antenna according to Embodiment 1 of the present disclosure.

FIG. 6 is a diagram illustrating the strength of the electric wave with respect to the positional relationship between opening 11 of the metal housing and antenna 71 according to this embodiment. In detail, FIG. 6 illustrates the result of simulating the strength of the electric wave depending on the angle between opening 11 and antenna 71, while changing the angle.

The horizontal axis in FIG. 6 represents the angle between the long side direction of opening 11 and root portion 71*b* of antenna 71. Since the polarization plane of the electric wave most strongly radiated from antenna 71 is parallel to root portion 71*b* of antenna 71, the horizontal axis in FIG. 6 corresponds to the angle between the long side direction of opening 11 and the polarization plane of the electric wave most strongly radiated from antenna 71. The vertical axis in FIG. 6 represents the maximum gain of the electric wave radiated from opening 11 (main lobe strength) and the total efficiency.

Figure 7:
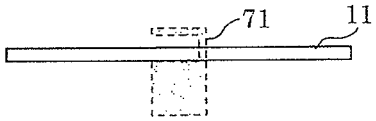
FIG. 7 is a diagram illustrating the positional relationship between the opening of the metal housing and the antenna according to Embodiment 1 of the present disclosure.
Figure 7:
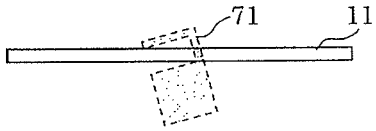
Figure 7:
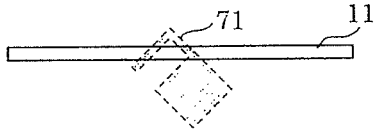
Figure 7:
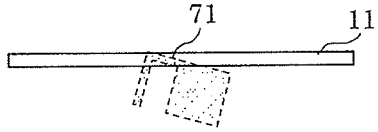
Figure 7:
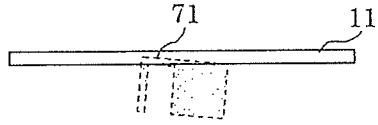
Figure 7:
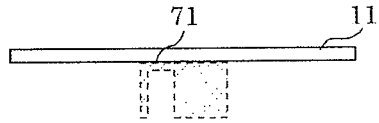

FIG. 7 is a diagram illustrating the positional relationship between opening 11 of the metal housing and antenna 71 according to this embodiment. The strength of the electric wave in the case where the angle between the long side direction of opening 11 and root portion 71*b* of antenna 71 is 0°, 5°, 15°, 45°, 75°, and 90° is simulated as illustrated in FIG. 7.

As illustrated in FIG. 6, the maximum gain and the total efficiency are saturated and stable in the range greater than or equal to 15° and less than or equal to 90°. This indicates that antenna 71 is to be installed in luminaire body 10 so that the angle between the long side direction of opening 11 and root portion 71*b* of antenna 71 is in the range greater than or equal to 15° and less than or equal to 90°.

Figure 8A:
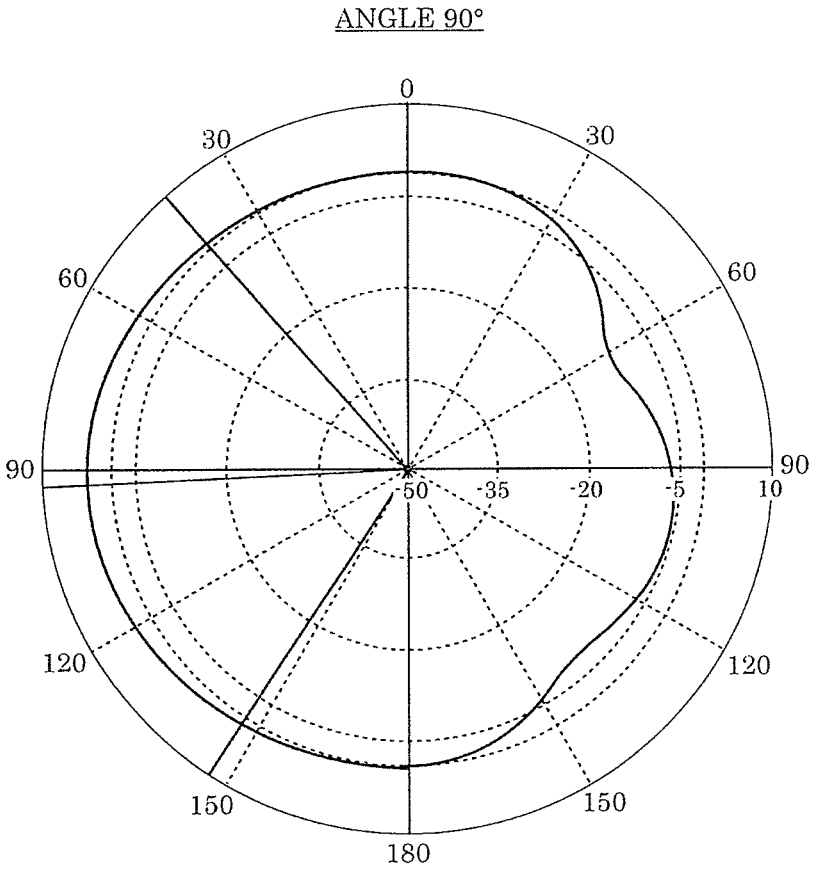
FIG. 8A is a diagram illustrating a radiation pattern in the case where the angle between the opening of the metal housing and the antenna is 90° according to Embodiment 1 of the present disclosure.
Figure 8B:
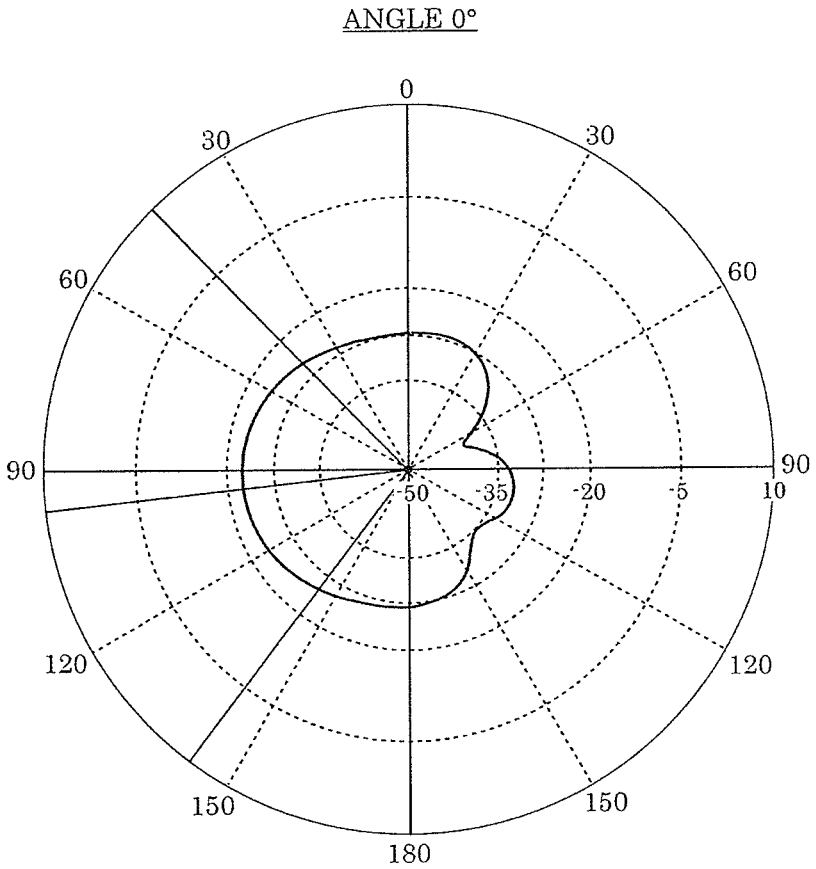
FIG. 8B is a diagram illustrating a radiation pattern in the case where the angle between the opening of the metal housing and the antenna is 0° according to Embodiment 1 of the present disclosure.

FIGS. 8A and 8B are diagrams respectively illustrating radiation patterns in the case where the angle between opening 11 of the metal housing and antenna 71 is 90° and in the case where the angle between opening 11 of the metal housing and antenna 71 is 0° according to this embodiment.

The maximum strength of the main lobe is about 3 dB in the case where the angle is 90°, and about −23 dB in the case where the angle is 0°, as illustrated in FIGS. 8A and 8B. Thus, the strength of the electric wave is greater in the case where the angle is 90° than in the case where the angle is 0°.

The above indicates that antenna 71 is to be positioned so that the polarization plane of the electric wave most strongly radiated from antenna 71 is at an angle of at least ±15° with respect to the long side direction of opening 11. In other words, antenna 71 is to be positioned so that the polarization plane of the electric wave most strongly radiated from antenna 71 is in the range greater than or equal to 15° and less than or equal to 165°, and greater than or equal to 195° and less than or equal to 345°, with respect to the long side direction of opening 11.

[Conclusion]

As described above, luminaire 1 according to this embodiment includes: power circuit 60 that supplies power to light source 2; antenna 71 that at least one of transmits and receives a wireless signal; and luminaire body 10 that contains antenna 71 and power circuit 60. Luminaire body 10 has opening 11, and antenna 71 and opening 11 are arranged to cause a polarization plane of an electric wave most strongly radiated from antenna 71 and a polarization plane of an electric wave most strongly radiated from opening 11 to substantially coincide with each other.

Thus, in this embodiment, the metal housing has opening 11 that functions as a slot antenna to radiate the electric wave from antenna 71 placed in the metal housing to the outside. This ensures the communication function of wireless communication.

Moreover, in this embodiment, antenna 71 and opening 11 are arranged so that the polarization plane of the electric wave most strongly radiated from antenna 71 and the polarization plane of the electric wave most strongly radiated from opening 11 substantially coincide with each other. The strength of the electric wave from opening 11 can be increased in such a way, as illustrated in FIG. 6 and the like. This improves the communication quality of wireless communication.

For example, the metal housing is substantially a rectangular parallelepiped, opening 11 is substantially rectangular in shape, a long side direction of opening 11 is parallel to a long side direction of the metal housing, and antenna 71 is positioned with the polarization plane of the electric wave most strongly radiated from antenna 71 being at an angle of at least ±15° with respect to the long side direction of opening 11.

The strength of the electric wave from opening 11 can be increased in such a way, thus improving the communication quality of wireless communication.

For example, opening 11 is substantially rectangular in shape, and a length of a long side of opening 11 is greater than or equal to substantially half a wavelength corresponding to a frequency of the wireless signal.

This enables efficient transmission or reception of the wireless signal.

For example, antenna 71 is mounted on printed wiring board 73.

This enables a reduction in size of the antenna and a reduction in the number of components.

For example, opening 11 is a slit opening.

Such opening 11 can efficiently function as a slot antenna.

Embodiment 2

Luminaire

The following describes a luminaire according to Embodiment 2. The following description mainly focuses on the differences from Embodiment 1, and may omit the same parts.

Figure 9:
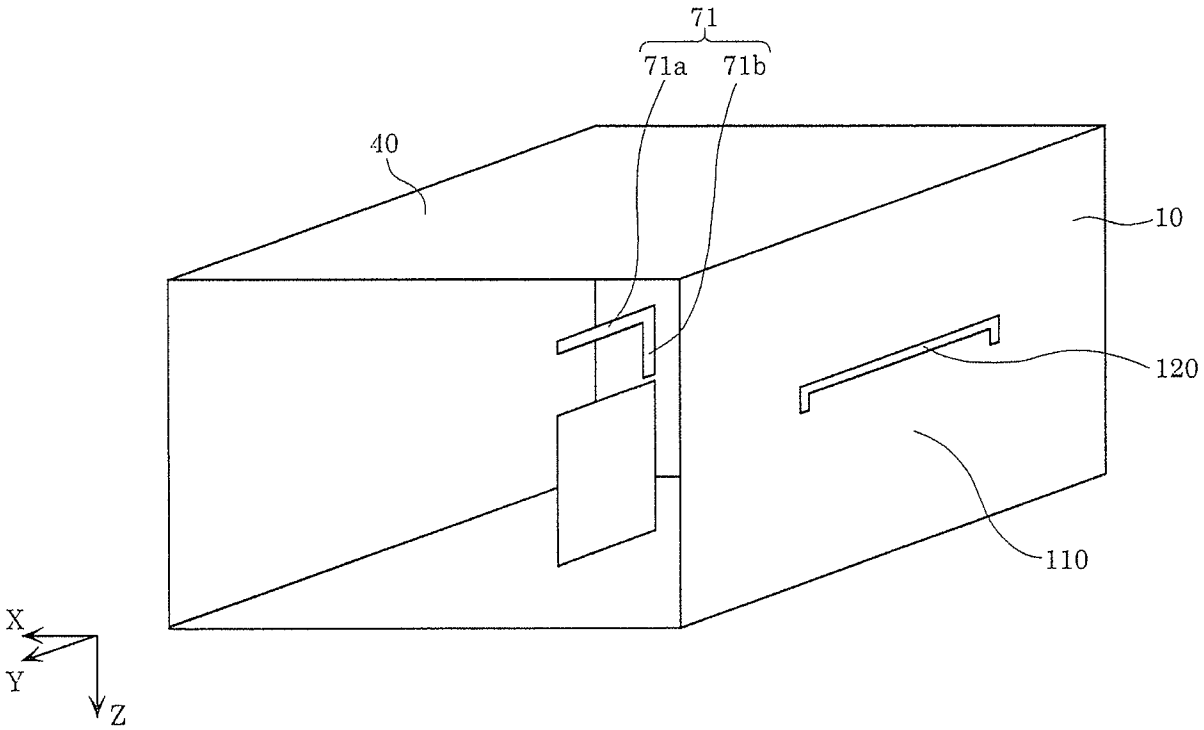
FIG. 9 is a diagram illustrating the positional relationship between the opening of the metal housing and the antenna according to Embodiment 2 of the present disclosure.

FIG. 9 is a diagram illustrating the positional relationship between first opening 120 of the metal housing and antenna 71 according to this embodiment.

In this embodiment, first opening 120 is formed in side surface 110 of the metal housing instead of opening 11 in Embodiment 1, as can be seen from the comparison with FIG. 4. First opening 120 differs in shape from opening 11.

First opening 120 is described in detail below.

[Opening]

Figure 10A:
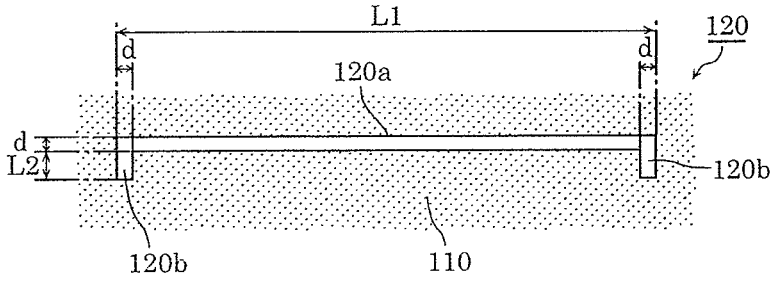
FIG. 10A is a plan view illustrating the shape of the opening of the metal housing according to Embodiment 2 of the present disclosure.

FIG. 10A is a plan view illustrating the shape of first opening 120 of the metal housing according to this embodiment.

In this embodiment, first opening 120 is formed in side surface 110 of the metal housing, as illustrated in FIG. 9. In detail, first opening 120 is formed in side surface 110 of luminaire body 10.

First opening 120 is a slit opening. As illustrated in FIG. 10A, first opening 120 has long side portion 120*a* and two short side portions 120*b*. Two short side portions 120*b* are positioned orthogonally at the respective ends of long side portion 120*a*.

Width d of first opening 120 is substantially constant. Let L1 be the length of long side portion 120*a*, and L2 be the length of each short side portion 120*b*. The length of first opening 120 along the slit direction is L1+2×L2. Thus, the length of first opening 120 along the slit direction is the total length of long side portion 120*a* and two short side portions 120*b*.

In this embodiment, the length of first opening 120 along the slit direction is greater than or equal to substantially half the wavelength corresponding to the wireless signal frequency. For example, when the wireless signal uses the frequency band of 2.4 GHz, half the wavelength corresponding to this frequency is about 62 mm. Hence, for example, first opening 120 illustrated in FIG. 10A is formed so that length L1 of long side portion 120*a* is 62 mm, length L2 of each short side portion 120*b* is 4 mm, and width d is 0.5 mm.

With first opening 120 illustrated in FIG. 10A, the standing wave ratio (SWR) is 1.3, and the main lobe strength is 2.6 dB. Thus, the power efficiency is improved, and the electric wave is radiated efficiently. The detailed antenna characteristics of first opening 120 are illustrated in (a) in FIG. 11.

[Opening Group]

Although FIG. 10A illustrates an example where only one first opening 120 is formed in side surface 110 of the metal housing, this is not a limitation. A plurality of openings including first opening 120 may be formed in side surface 110 of the metal housing. In other words, an opening group including a plurality of openings may be formed in side surface 110 of the metal housing.

Figure 10B:
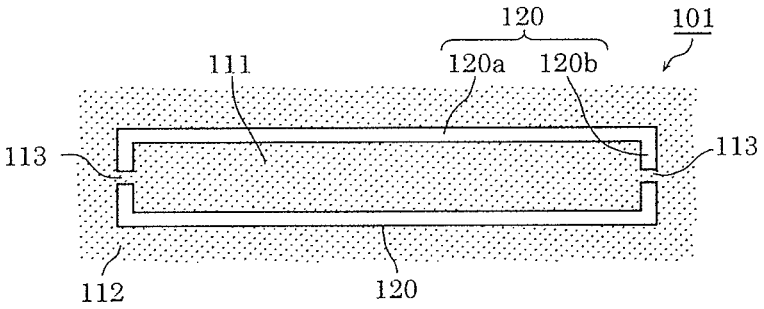
FIG. 10B is a plan view illustrating the shape of an opening group of the metal housing according to Embodiment 2 of the present disclosure.
Figure 10C:
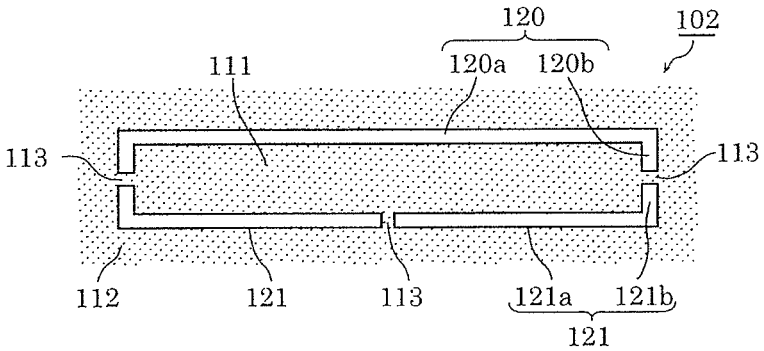
FIG. 10C is a plan view illustrating another shape of the opening group of the metal housing according to Embodiment 2 of the present disclosure.
Figure 10D:
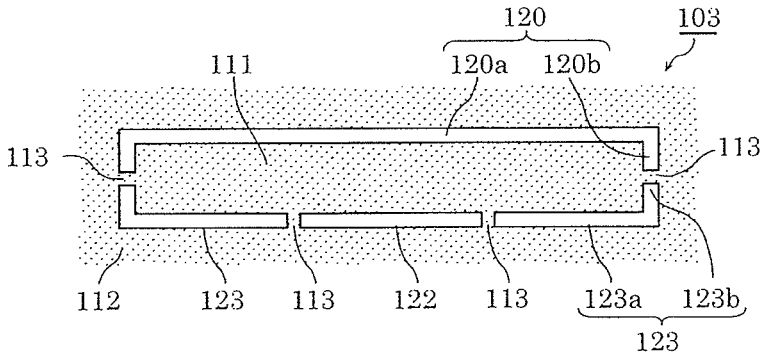
FIG. 10D is a plan view illustrating another shape of the opening group of the metal housing according to Embodiment 2 of the present disclosure.
Figure 10E:
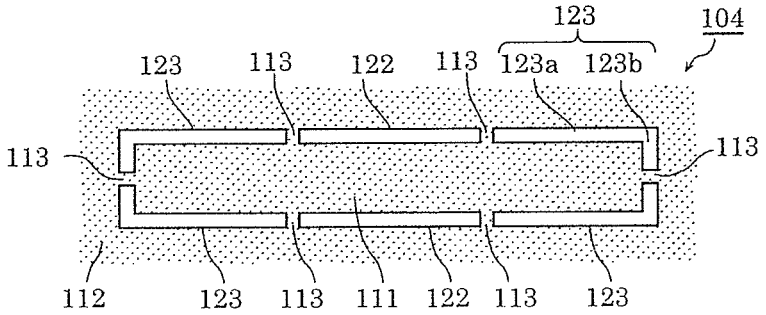
FIG. 10E is a plan view illustrating another shape of the opening group of the metal housing according to Embodiment 2 of the present disclosure.
Figure 10F:
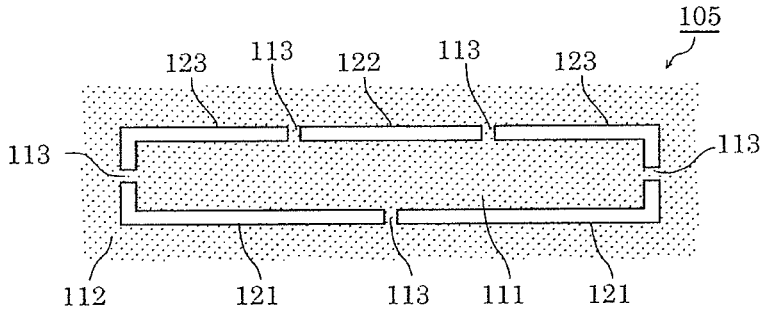
FIG. 10F is a plan view illustrating another shape of the opening group of the metal housing according to Embodiment 2 of the present disclosure.
Figure 10G:
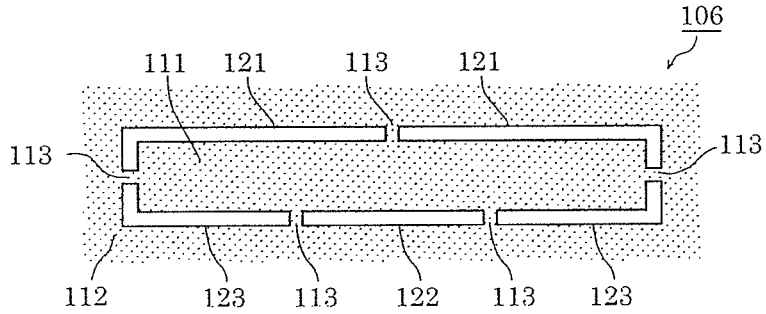
FIG. 10G is a plan view illustrating another shape of the opening group of the metal housing according to Embodiment 2 of the present disclosure.

The following describes examples of such an opening group with reference to FIGS. 10B to 10G. FIGS. 10B to 10D are plan views respectively illustrating the shapes of opening groups 101 to 103 of the metal housing according to this embodiment. FIGS. 10E to 10G are plan views respectively illustrating the shapes of opening groups 104 to 106 of the metal housing according to comparative examples.

As illustrated in FIGS. 10B to 10G, opening groups 101 to 106 are each formed in side surface 110 of the metal housing. Side surface 110 of the metal housing includes first plate portion 111, second plate portion 112, and connecting portion 113.

First plate portion 111 is a part surrounded by the plurality of openings (i.e. closing plate). Second plate portion 112 is a part outside the plurality of openings. Connecting portion 113 is a part between an end of one of the plurality of openings and an end of another one of the plurality of openings, and connects first plate portion 111 and second plate portion 112. In other words, the plurality of openings and the plurality of connecting portions 113 are provided between first plate portion 111 and second plate portion 112.

First plate portion 111, second plate portion 112, and connecting portions 113 are formed, for example, by processing one plate member made of metal. Thus, first plate portion 111, second plate portion 112, and connecting portions 113 are integrally formed from the same member. First plate portion 111, second plate portion 112, and connecting portions 113 therefore have substantially the same surface color.

As illustrated in FIGS. 10B to 10G, opening groups 101 to 106 each include a plurality of openings, first plate portion 111, and a plurality of connecting portions 113. Each opening group thus has a knockout structure.

The plurality of openings include first opening 120, second openings 121 to 123, etc.

Example 1

Opening group 101 illustrated in FIG. 10B is made up of two first openings 120, first plate portion 111, and two connecting portions 113.

Two first openings 120 have parts substantially parallel to each other. In detail, two first openings 120 are arranged so that respective long side portions 120*a* are parallel to each other. The ends of two first openings 120 face each other.

First plate portion 111 is a part surrounded by two first openings 120. First plate portion 111 is substantially rectangular, as illustrated in FIG. 10B. First plate portion 111 is connected to second plate portion 112 by two connecting portions 113.

Example 2

Opening group 102 illustrated in FIG. 10C is made up of one first opening 120, two second openings 121, first plate portion 111, and three connecting portions 113. First plate portion 111 is substantially rectangular. One first opening 120, two second openings 121, and three connecting portions 113 are provided along the periphery of first plate portion 111, i.e. along the periphery of the substantially rectangular shape.

Two second openings 121 each have long side portion 121*a* and short side portion 121*b*. Short side portion 121*b* is formed at the end of long side portion 121*a*, and is orthogonal to long side portion 121*a*. Thus, each second opening 121 is a substantially L-shaped slit opening. The length of second opening 121 along the slit direction is less than or equal to half the length of first opening 120 along the slit direction.

Two second openings 121 are arranged so that two long side portions 121*a* and long side portion 120*a* of first opening 120 are parallel to each other. Respective long side portions 121*a* of two second openings 121 lie on a straight line, and connecting portion 113 is provided between long side portions 121*a*. Each of two short side portions 120*b* of first opening 120 and short side portion 121*b* of a corresponding one of two second openings 121 lie on a straight line, and connecting portion 113 is provided between short side portion 120*b* and short side portion 121*b*.

Example 3

Opening group 103 illustrated in FIG. 10D is made up of one first opening 120, one second opening 122, two second openings 123, first plate portion 111, and four connecting portions 113. One first opening 120, one second opening 122, two second openings 123, and four connecting portions 113 are provided along the periphery of first plate portion 111, i.e. along the periphery of the substantially rectangular shape.

Second opening 122 is a substantially rectangular opening. Second opening 122 is positioned in parallel with long side portion 120*a* of first opening 120. The length of second opening 122 along the slit direction is less than or equal to half the length of first opening 120 along the slit direction.

Two second openings 123 each have long side portion 123*a* and short side portion 123*b*. Short side portion 123*b* is formed at the end of long side portion 123*a*, and is orthogonal to long side portion 123*a*. Thus, each second opening 123 is a substantially L-shaped slit opening. The length of second opening 123 along the slit direction is less than or equal to half the length of first opening 120 along the slit direction.

Second opening 122 and respective long side portions 123*a* of two second openings 123 lie on a straight line, and connecting portion 113 is provided between each end of second opening 122 and corresponding long side portion 123*a*. Each of two short side portions 120*b* of first opening 120 and short side portion 123*b* of a corresponding one of two second openings 123 lie on a straight line, and connecting portion 113 is provided between short side portion 120*b* and short side portion 123*b*.

Comparative Example 1

Opening group 104 illustrated in FIG. 10E is made up of two second openings 122, four second openings 123, first plate portion 111, and six connecting portions 113. Two second openings 122, four second openings 123, and six connecting portions 113 are provided along the periphery of first plate portion 111, i.e. along the periphery of the substantially rectangular shape.

One second opening 122 and respective long side portions 123*a* of two second openings 123 lie on a straight line. The other second opening 122 and respective long side portions 123*a* of the other two second openings 123 also lie on a straight line. The directions in which these elements are arranged are parallel to each other. In other words, two second openings 122 are arranged in parallel with each other. Connecting portion 113 is provided between second opening 122 and long side portion 123*a* of each of two second openings 123.

Respective short side portions 123*b* of two second openings 123 lie on a straight line. Respective short side portions 123*b* of the other two second openings 123 also lie on a straight line. The directions in which these elements are arranged are parallel to each other. Connecting portion 113 is provided between two short side portions 123*b*.

Opening group 104 does not include first opening 120, as illustrated in FIG. 10E. Accordingly, the length of every opening in opening group 104 along the slit direction is less than substantially half the wavelength corresponding to the wireless signal frequency.

Comparative Example 2

Opening group 105 illustrated in FIG. 10F is made up of two second openings 121, one second opening 122, two second openings 123, first plate portion 111, and five connecting portions 113.

Opening group 105 has the shape that combines opening group 102 illustrated in FIG. 10C and opening group 104 illustrated in FIG. 10E, as illustrated in FIG. 10F. Two second openings 121, one second opening 122, two second openings 123, and five connecting portions 113 are provided along the periphery of first plate portion 111, i.e. along the periphery of the substantially rectangular shape.

Opening group 105 does not include first opening 120, as illustrated in FIG. 10F. Accordingly, the length of every opening in opening group 105 along the slit direction is less than substantially half the wavelength corresponding to the wireless signal frequency.

Comparative Example 3

Opening group 106 illustrated in FIG. 10G is made up of two second openings 121, one second opening 122, two second openings 123, first plate portion 111, and five connecting portions 113.

Opening group 106 has opening group 105 illustrated in FIG. 10F turned upside down, as illustrated in FIG. 10G.

[Characteristics of Opening Group]

The antenna characteristics of opening groups 101 to 106 mentioned above are described below, with reference to FIG. 11.

FIG. 11 is a diagram illustrating the relationship between the shape of the opening group of the metal housing and the communication performance according to this embodiment. In FIG. 11, (a) to (g) respectively correspond to first opening 120 and opening groups 101 to 106 illustrated in FIGS. 10A to 10G. FIG. 11 illustrates the standing wave ratio (SWR), the main lobe characteristics (strength, direction, angle width), and the side lobe strength in each case.

As illustrated in (a) to (d) in FIG. 11, in first opening 120 and opening groups 101 to 103, the SWR is less than or equal to 1.5, and the electric wave is radiated efficiently. In opening groups 101 to 103, the main lobe strength is 5.1 dB to 5.7 dB, which is sufficiently high as compared with the case where only first opening 120 is provided (2.6 dB) as illustrated in FIG. 10A. Thus, by forming any of opening groups 101 to 103 in the metal housing, the electric wave can be radiated more efficiently, with it being possible to improve the communication quality of wireless communication.

In opening groups 104 to 106, on the other hand, the SWR is high, and the main lobe strength is low, as illustrated in (e) to (g) in FIG. 11. This indicates that opening groups 104 to 106 each fail to function as an antenna.

Opening groups 104 to 106 each do not include first opening 120, as illustrated in FIGS. 10E to 10G. In other words, opening groups 104 to 106 each include only openings less than substantially half the wavelength corresponding to the wireless signal frequency. Conversely, the inclusion of an opening (e.g. first opening 120) greater than or equal to substantially half the wavelength corresponding to the wireless signal frequency enables the opening group to function as an antenna.

[Conclusion]

As described above, in the luminaire according to this embodiment, the metal housing has one or more openings in side surface 110, the one or more openings are each a slit opening, and a length of first opening 120 along a slit direction is greater than or equal to substantially half a wavelength corresponding to a frequency of the wireless signal, first opening 120 being at least one of the one or more openings.

Thus, in this embodiment, the metal housing has first opening 120 that functions as a slot antenna to radiate the electric wave from antenna 71 placed in the metal housing to the outside. This ensures the communication function of wireless communication.

Moreover, in this embodiment, the length of first opening 120 along the slit direction is greater than or equal to substantially half the wavelength corresponding to the wireless signal frequency. The electric wave can therefore be efficiently radiated, as can be understood from the comparison between (a) and (e) to (g) in FIG. 11. This improves the communication quality of wireless communication.

For example, the metal housing has a plurality of openings in side surface 110, and side surface 110 of the metal housing includes: first plate portion 111 surrounded by the plurality of openings; second plate portion 112 that is a part outside the plurality of openings; and connecting portion 113 that is a part between an end of one of the plurality of openings and an end of another one of the plurality of openings and connects first plate portion 111 and second plate portion 112.

By forming the plurality of openings according to the knockout structure in this way, the electric wave can be radiated more efficiently than in the case where only one first opening 120 is formed, as can be understood from the comparison between (a) and (b) to (d) in FIG. 11. In addition, the knockout structure can keep external dust or foreign matter from entering the metal housing. This prevents the situation where heat is generated as a result of dust and the like adhering to power circuit 60 and consequently fire or smoking occurs.

For example, the plurality of openings may include a plurality of first openings 120, and the plurality of first openings 120 may have parts substantially parallel to each other.

In this way, the electric wave can be radiated more efficiently than in the case where only one first opening 120 is formed, as can be understood from the comparison between (a) and (b) in FIG. 11.

For example, the plurality of openings may include second opening 121 different from first opening 120, and a length of second opening 121 along a slit direction may be less than or equal to half the length of first opening 120 along the slit direction.

In this way, the electric wave can be radiated more efficiently than in the case where only one first opening 120 is formed, as can be understood from the comparison between (a) and (c) to (d) in FIG. 11.

For example, first plate portion 111, second plate portion 112, and connecting portion 113 may have substantially a same surface color.

This makes the openings unnoticeable, which is desirable in aesthetic terms. Besides, in the case where the openings are formed in reflector 40, a reduction in reflection function of reflector 40 can be suppressed.

Variation of Embodiment 2

The following describes a variation of the luminaire according to Embodiment 2, with reference to drawings.

In the luminaire in this variation, a plurality of opening groups are formed in side surfaces of the metal housing.

Figure 12:
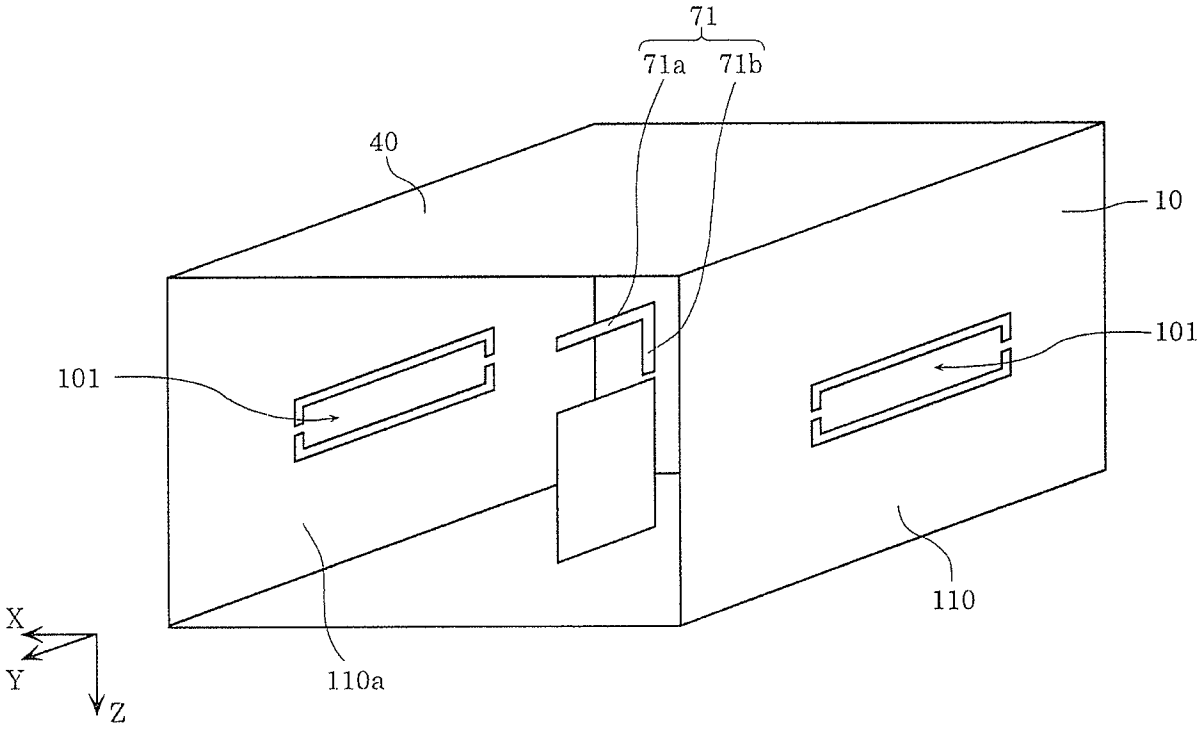
FIG. 12 is a diagram illustrating the positional relationship between a plurality of opening groups and the antenna according to a variation of Embodiment 2 of the present disclosure.

FIG. 12 is a diagram illustrating the positional relationship between a plurality of opening groups 101 and antenna 71 according to this variation.

In the luminaire according to this variation, luminaire body 10 and reflector 40 constitute the metal housing, and two opening groups 101 are formed in side surfaces of the metal housing. In detail, opening group 101 is formed in each of opposite side surfaces 110 and 110*a* of the metal housing. Two opening groups 101 face each other with antenna 71 in between.

Thus, for example, a plurality of opening groups 101 each including first plate portion 111, connecting portion 113, and a plurality of openings are formed in side surfaces 110 of the metal housing in this variation.

This enables the radiation pattern to be changed.

Although two opening groups 101 are provided in the example illustrated in FIG. 12, different opening groups may be provided instead. For example, opening group 101 and opening group 102 may be formed respectively in side surface 110 and side surface 110*a*. Moreover, two opening groups 101 may be formed in one side surface 110.

For example, the luminaire may further include an insulator in one or more openings.

In the knockout structure, for instance, there is a possibility of erroneous piercing during construction. Such erroneous piercing can be suppressed by providing the insulator.

Embodiment 3

[Luminaire]

The following describes a luminaire according to Embodiment 3. While a straight-tube LED lamp is used as an example of the luminaire in Embodiments 1 and 2, a downlight is used as an example in this embodiment.

Figure 13:
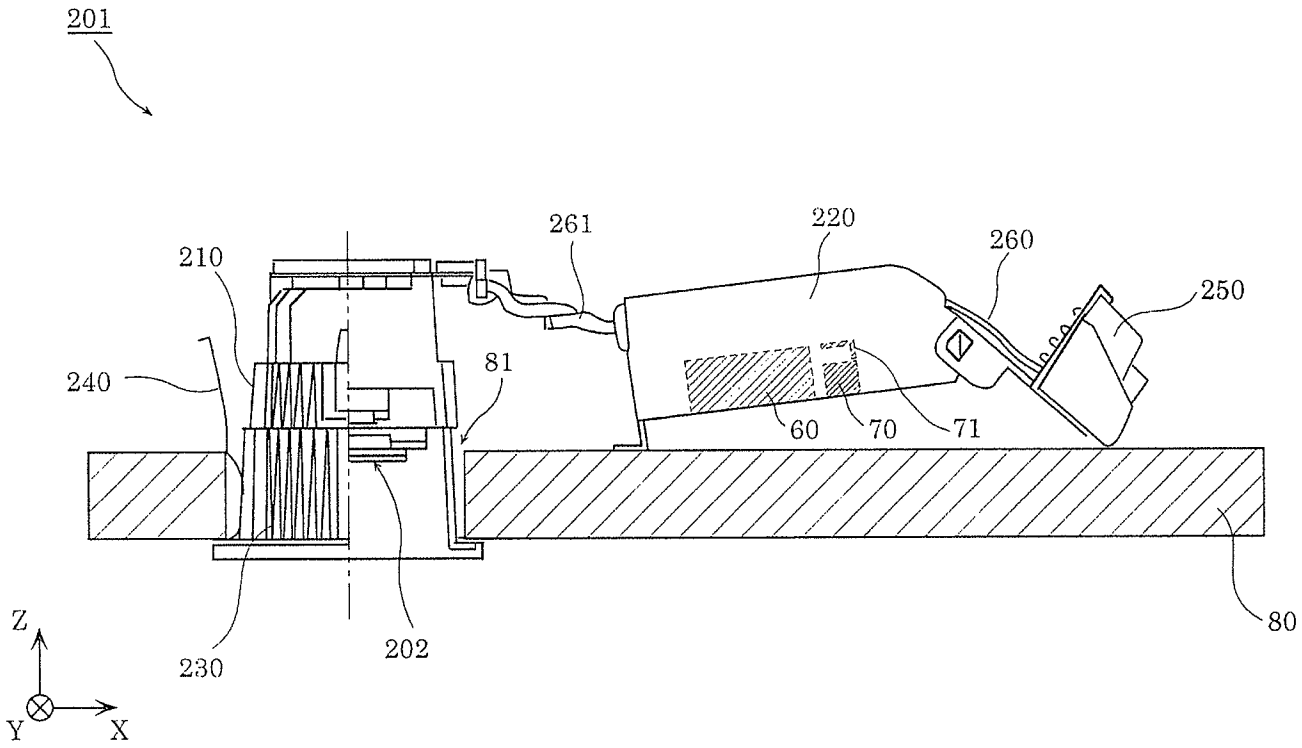
FIG. 13 is a sectional view illustrating a luminaire according to Embodiment 3 of the present disclosure.

FIG. 13 is a sectional view illustrating luminaire 201 according to this embodiment. In detail, FIG. 13 illustrates the state in which luminaire 201 is installed in embedding hole 81 formed in ceiling 80.

Luminaire 201 according to this embodiment is, for example, a recessed luminaire such as a downlight that is embedded in ceiling 80 of a house or the like to emit light downward (toward the floor or wall). Luminaire 201 is capable of wireless communication.

As illustrated in FIG. 13, luminaire 201 includes luminaire body 210 and circuit case 220. Light source 202 is contained in luminaire body 210. Power circuit 60 and wireless module 70 that includes antenna 71 are contained in circuit case 220. Luminaire 201 further includes heat radiation fin 230, attachment spring 240, and attachment portion 250.

As illustrated in FIG. 13, the X axis direction is the direction of connection between luminaire body 210 and circuit case 220 in the plane parallel to ceiling 80, the Y axis direction is the direction orthogonal to the X axis direction in the plane parallel to ceiling 80, and the Z axis direction is the direction perpendicular to ceiling 80.

Each structural member in luminaire 201 is described in detail below.

Light source 202 is a light source for illumination including a light emitting module having a light emitting element, and emits predetermined light. In this embodiment, light source 202 includes a COB light emitting module, or a light emitting module using an SMD LED element.

Luminaire body 210 is a housing which is substantially a truncated cone. A plurality of heat radiation fins 230 protruding outward are provided on the outer peripheral surface of luminaire body 210. Attachment spring 240 is also attached to the outer peripheral surface of luminaire body 210.

Circuit case 220 is a metal housing that contains power circuit 60 and antenna 71. Circuit case 220 is formed, for example, by bending a plate member made of metal such as aluminum.

The detailed structure of circuit case 220 will be described later.

Heat radiation fins 230 are fins for radiating heat generated when light source 202 emits light, to the outside. For example, heat radiation fins 230 are formed integrally with luminaire body 210.

Attachment spring 240 is fixed to the outer peripheral surface of luminaire body 210, and is biased outward. Attachment spring 240 is used to install luminaire 201 (luminaire body 210) into embedding hole 81.

Attachment portion 250 is connected to a cable (not illustrated) that is connected to system power (utility power) which is the supplier of AC power. Attachment portion 250 feeds AC power obtained via the cable, to power circuit 60 in circuit case 220 via cable 260. Attachment portion 250 is provided at one end of circuit case 220 in the longitudinal direction.

Cable 260 is a cable for supplying the AC power received by attachment portion 250 to power circuit 60 in circuit case 220. Cable 261 is a cable for supplying the power from power circuit 60 in circuit case 220 to light source 202 in luminaire body 210.

[Circuit Case]

Circuit case 220 according to this embodiment is described in detail below.

Figure 14A:
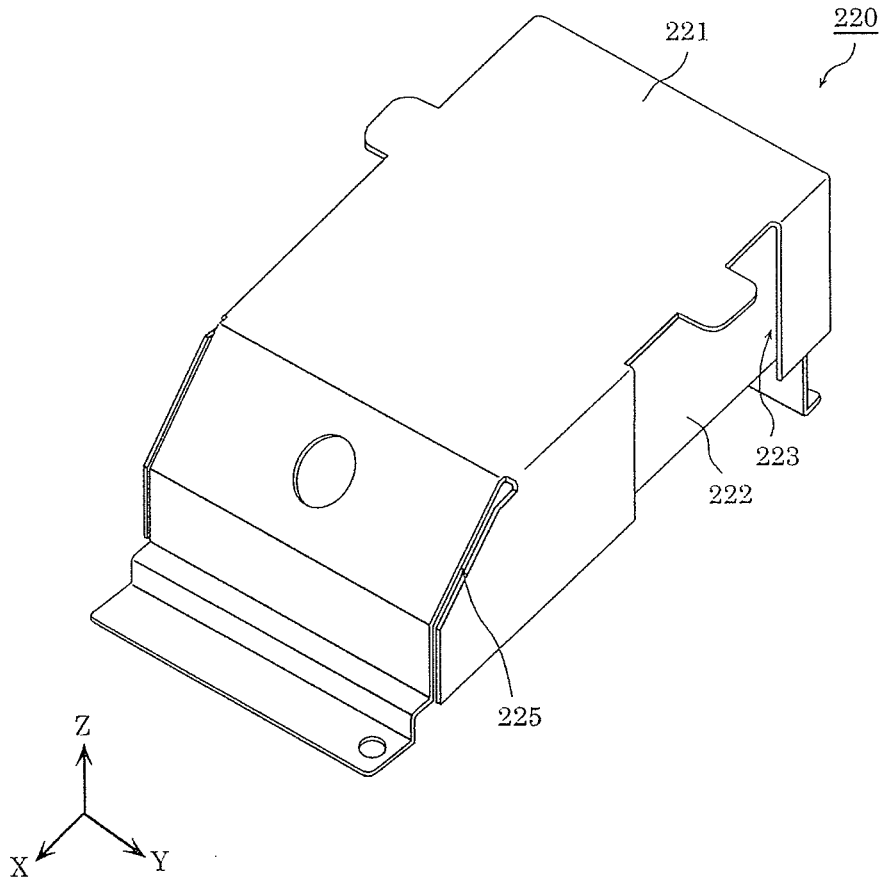
FIG. 14A is a perspective view illustrating a circuit case according to Embodiment 3 of the present disclosure.
Figure 14B:
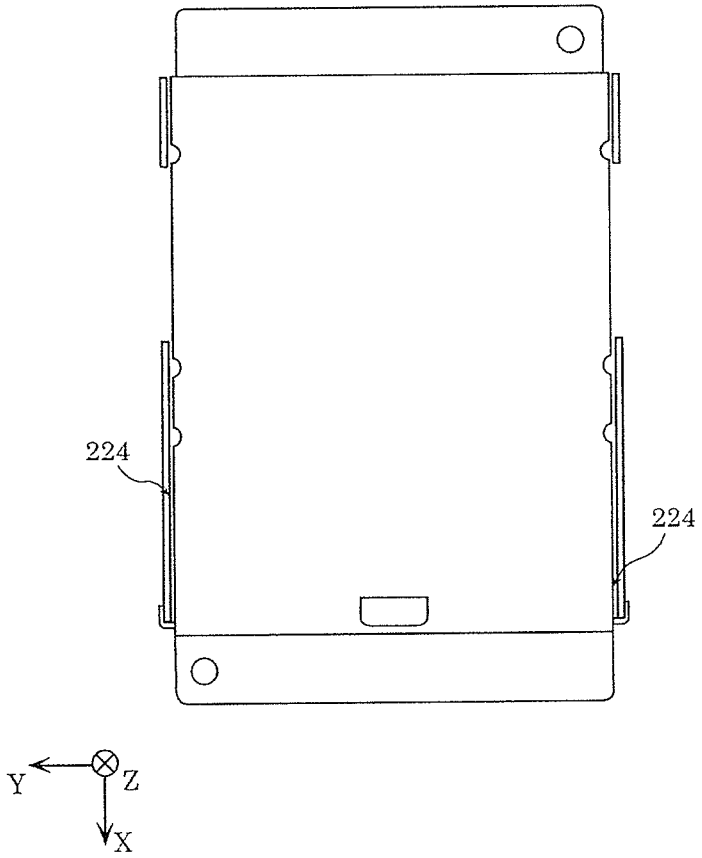
FIG. 14B is a bottom view illustrating the circuit case according to Embodiment 3 of the present disclosure.

FIGS. 14A and 14B are respectively a perspective view and bottom view illustrating circuit case 220 according to this embodiment.

Circuit case 220 according to this embodiment is a polyhedral metal housing, and has upper cover 221 and lower cover 222 that are combined so as to create a gap. By combining upper cover 221 and lower cover 222, openings 223 and 224 are formed in circuit case 220, as illustrated in FIGS. 14A and 14B. Thus, openings 223 and 224 are gaps created when combining upper cover 221 and lower cover 222.

Figure 15:
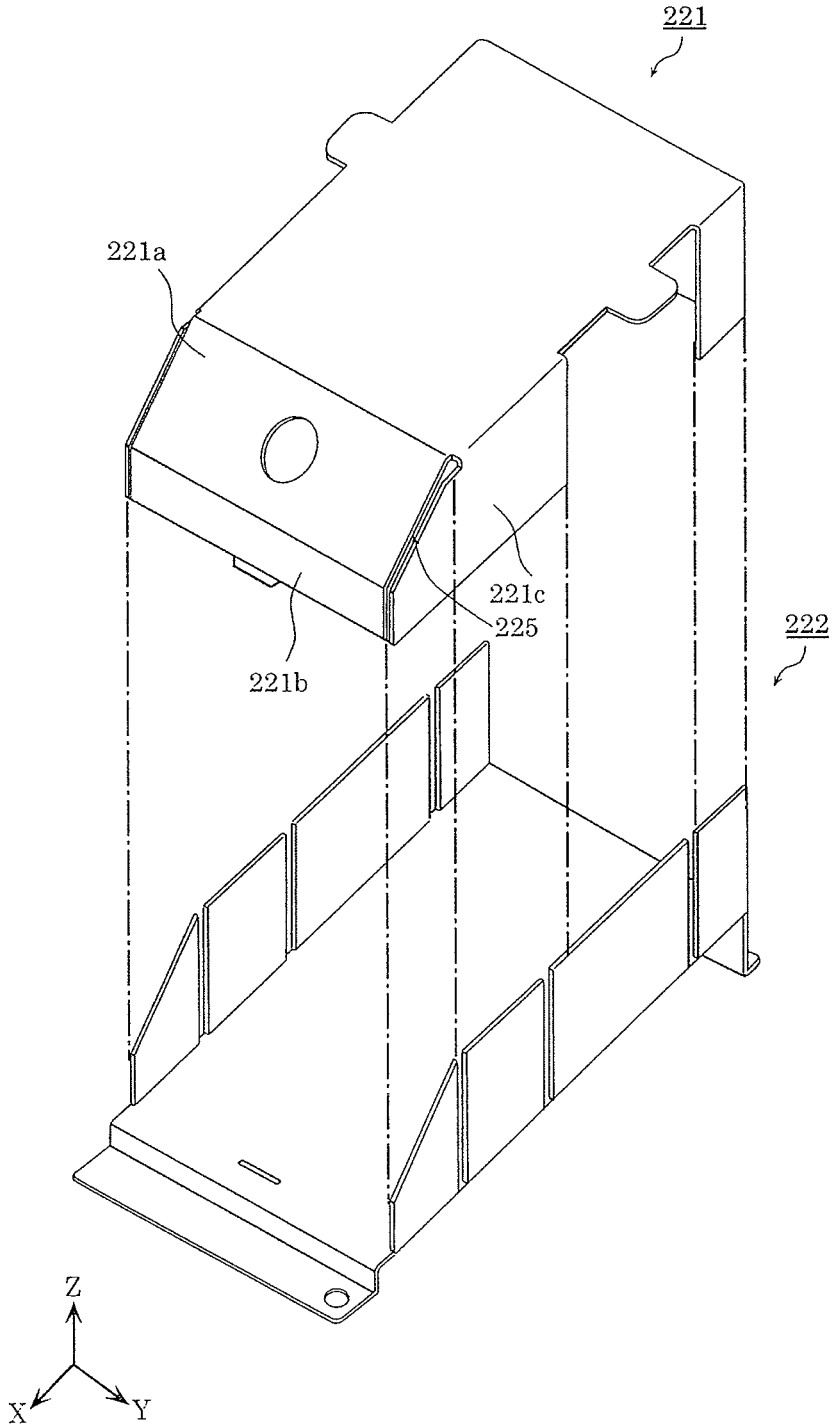
FIG. 15 is an exploded perspective view illustrating the circuit case according to Embodiment 3 of the present disclosure.

FIG. 15 is an exploded perspective view illustrating circuit case 220 according to this embodiment.

Upper cover 221 and lower cover 222 are an example of a metal structure. Upper cover 221 and lower cover 222 are each formed by processing a plate member made of metal. Upper cover 221 and lower cover 222 each have a plurality of substantially rectangular surfaces.

Upper cover 221 has opening 225. Opening 225 is a gap formed in upper cover 221.

Opening 225 is formed along a side of a substantially rectangular surface. For example, upper cover 221 has surfaces 221*a* to 221*c*, as illustrated in FIG. 15. Surfaces 221*a* and 221*b* are perpendicular to surface 221*c*. Opening 225 is formed along two sides of surface 221*c*. In detail, opening 225 is formed between surface 221*c* and each of surfaces 221*a* and 221*b*.

As illustrated in FIG. 14A, opening 225 is positioned on sides of circuit case 220. In detail, opening 225 extends over two or more continuous sides of circuit case 220.

Moreover, opening 225 connects to opening 224. In other words, opening 225 forms one continuous opening together with opening 224, and this opening extends over three continuous sides of the polyhedron (i.e. three sides of surface 221*c*). The length of the opening is greater than or equal to substantially half the wavelength corresponding to the wireless signal frequency.

The radiation pattern of the electric wave can be changed by providing the plurality of openings 223 to 225 in circuit case 220 in the above-mentioned manner.

[Arrangement of Openings and Radiation Pattern]

The following describes how the radiation pattern changes according to the arrangement of openings in the metal housing, with reference to FIGS. 16A to 18B.

Figure 16A:
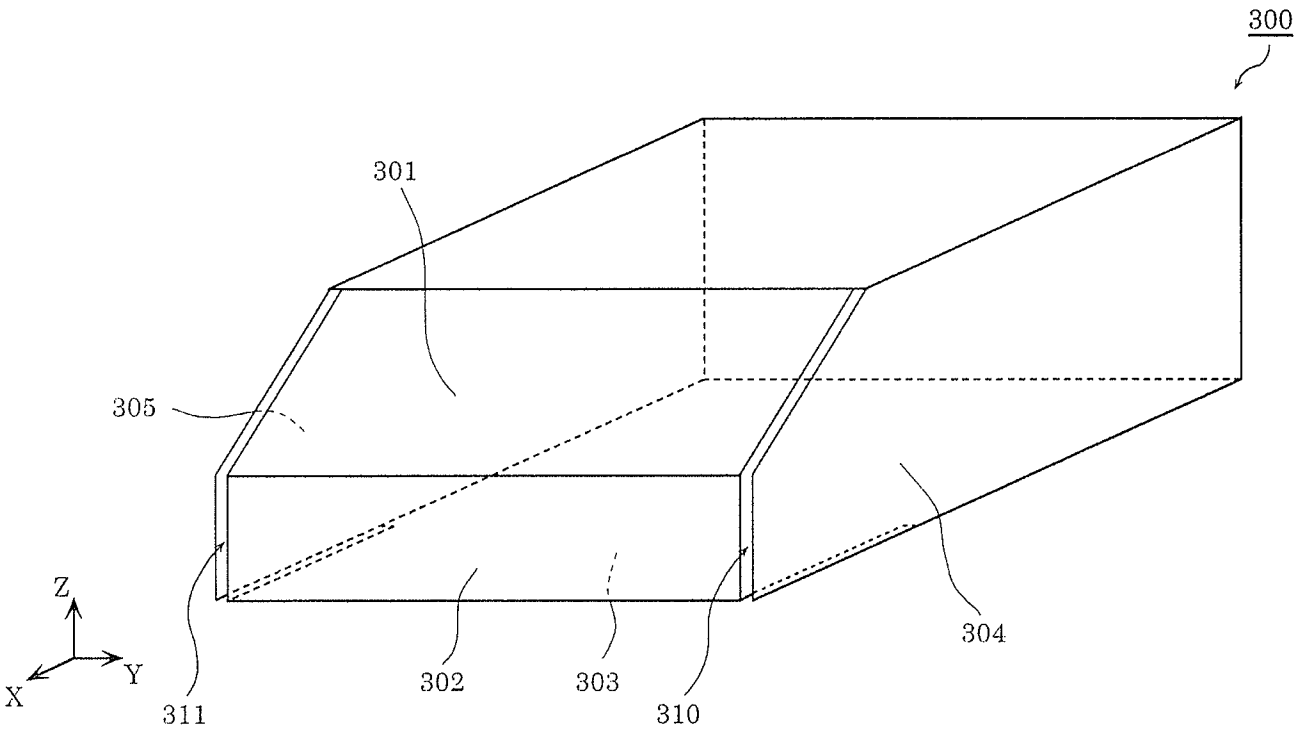
FIG. 16A is a perspective view illustrating the arrangement of openings of the metal housing according to Embodiment 3 of the present disclosure.
Figure 16B:
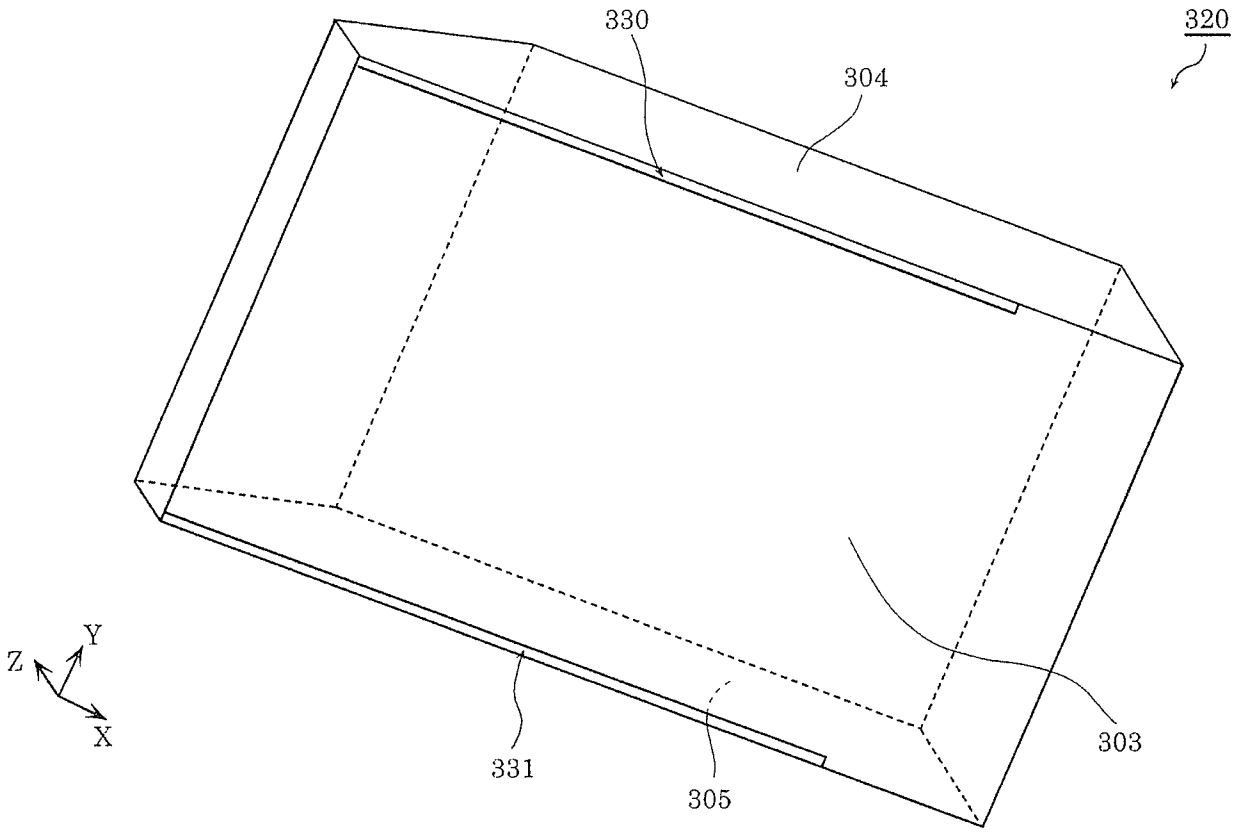
FIG. 16B is a perspective view illustrating the arrangement of openings of the metal housing according to a comparative example of Embodiment 3 of the present disclosure.

FIGS. 16A and 16B are each a diagram illustrating the arrangement of openings in the metal housing according to this embodiment.

Metal housing 300 illustrated in 16A is a metal housing which models circuit case 220 according to this embodiment. Metal housing 300 is a polyhedron, and has surfaces 301 to 305. Surfaces 304 and 305 are parallel to each other, and perpendicular to surfaces 301 to 303, as illustrated in FIG. 16A.

Metal housing 300 has two openings 310 and 311. Two openings 310 and 311 are parallel to each other.

Opening 310 is formed on sides of surface 304. In detail, opening 310 is formed between surface 304 and each of surfaces 301 to 303. Thus, opening 310 extends over three continuous sides of surface 304.

Opening 311 is formed on sides of surface 305. In detail, opening 311 is formed between surface 305 and each of surfaces 301 to 303. Thus, opening 311 extends over three continuous sides of surface 305.

FIG. 16B illustrates metal housing 320 that differs only in the positions of openings from metal housing 300 illustrated in FIG. 16A. Metal housing 320 illustrated in FIG. 16B has two openings 330 and 331. Two openings 330 and 331 are parallel to each other.

Opening 330 is formed on a side of surface 304. In detail, opening 330 is formed between surface 303 and surface 304.

Opening 331 is formed on a side of surface 305. In detail, opening 331 is formed between surface 303 and surface 305.

In FIGS. 16A and 16B, the YZ plane is the plane parallel to surface 302, the XY plane is the plane parallel to surface 303, and the XZ plane is the plane parallel to surfaces 304 and 305. Thus, the X axis, the Y axis, and the Z axis are orthogonal to each other. Surface 303 corresponds to the bottom surface, e.g. the surface on the side installed on ceiling 80. In other words, the living space exists on the surface 303 side (i.e. the Z axis negative direction).

Figure 17A:
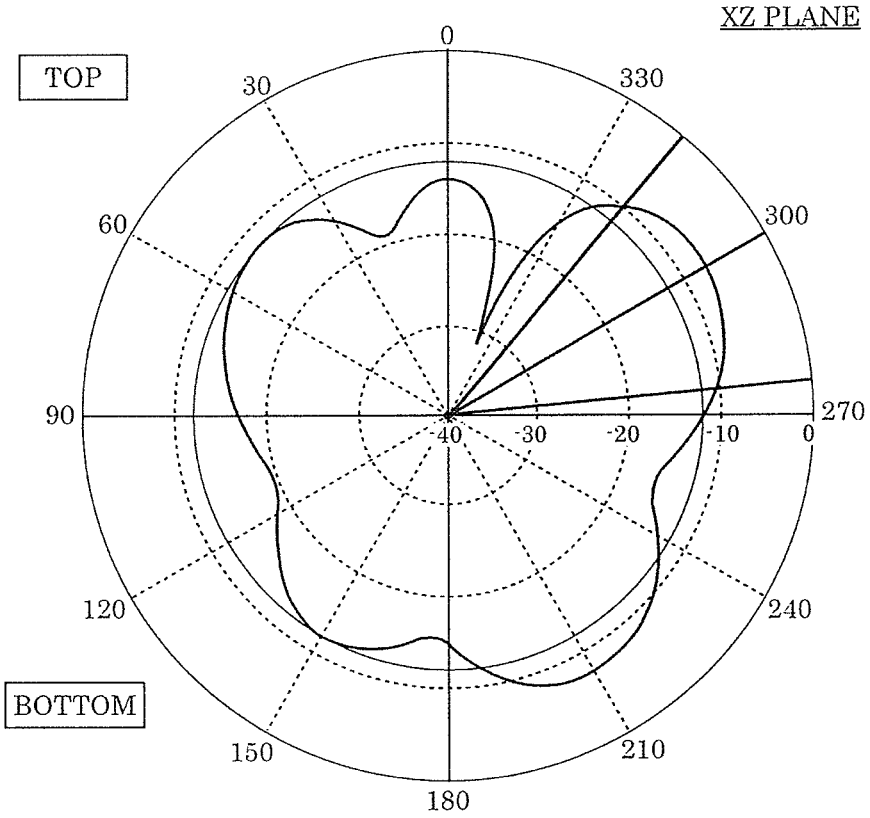
FIG. 17A is a diagram illustrating a radiation pattern in the XZ plane (plane parallel to openings) of the metal housing according to Embodiment 3 of the present disclosure.
Figure 17B:
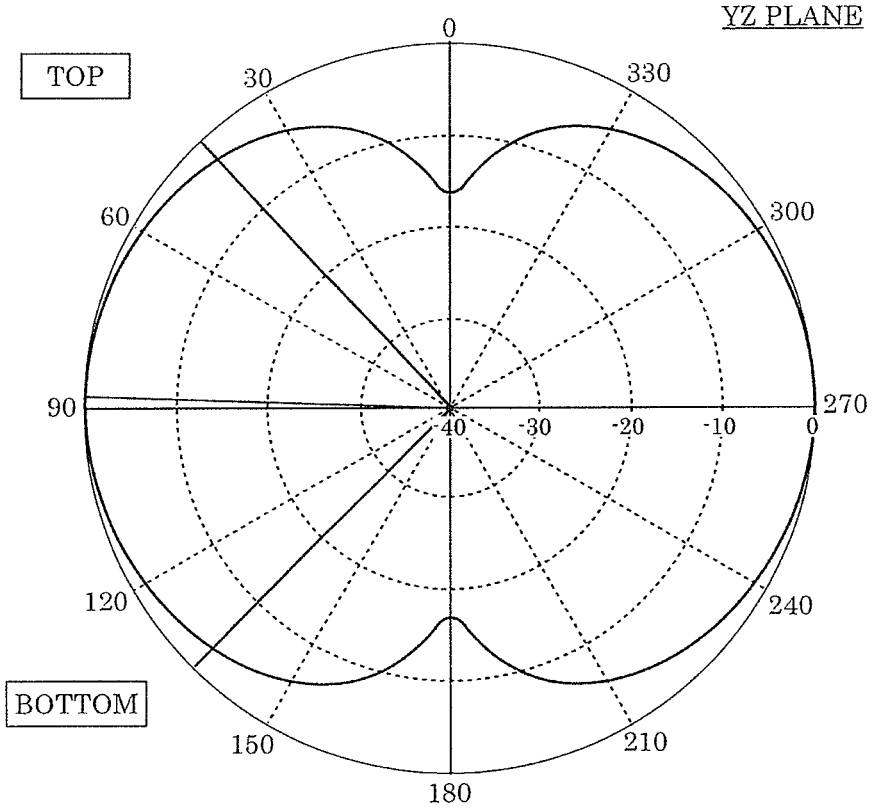
FIG. 17B is a diagram illustrating a radiation pattern in the YZ plane (plane perpendicular to openings) of the metal housing according to Embodiment 3 of the present disclosure.
Figure 18A:
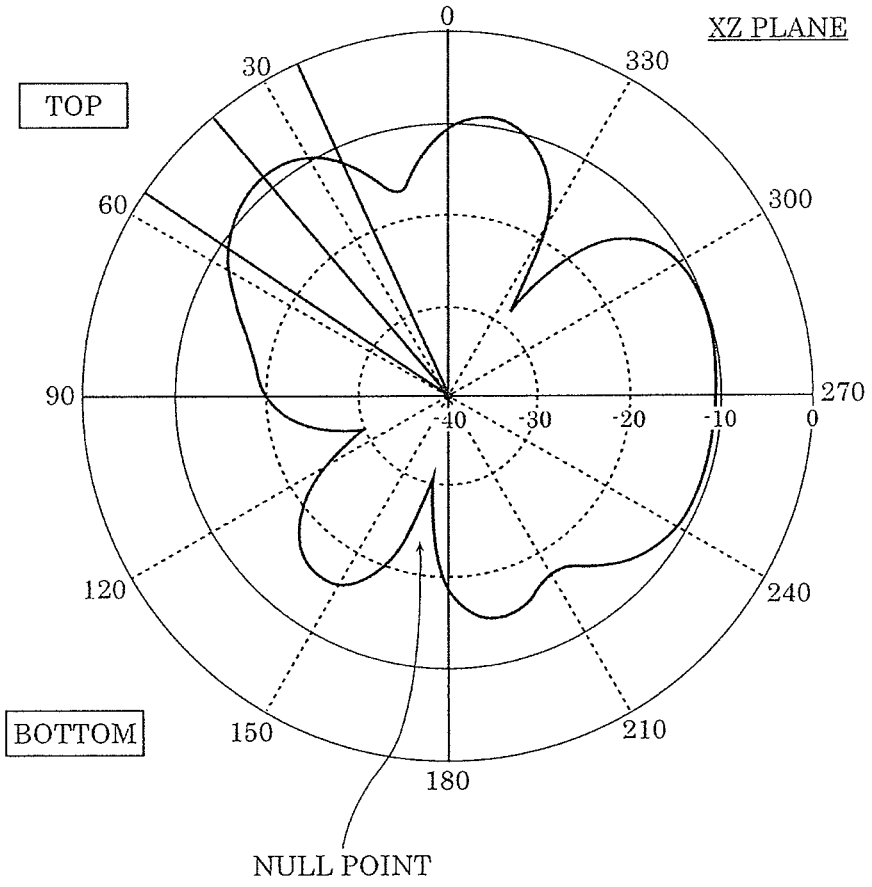
FIG. 18A is a diagram illustrating a radiation pattern in the XZ plane of the metal housing according to a comparative example of Embodiment 3 of the present disclosure.
Figure 18B:
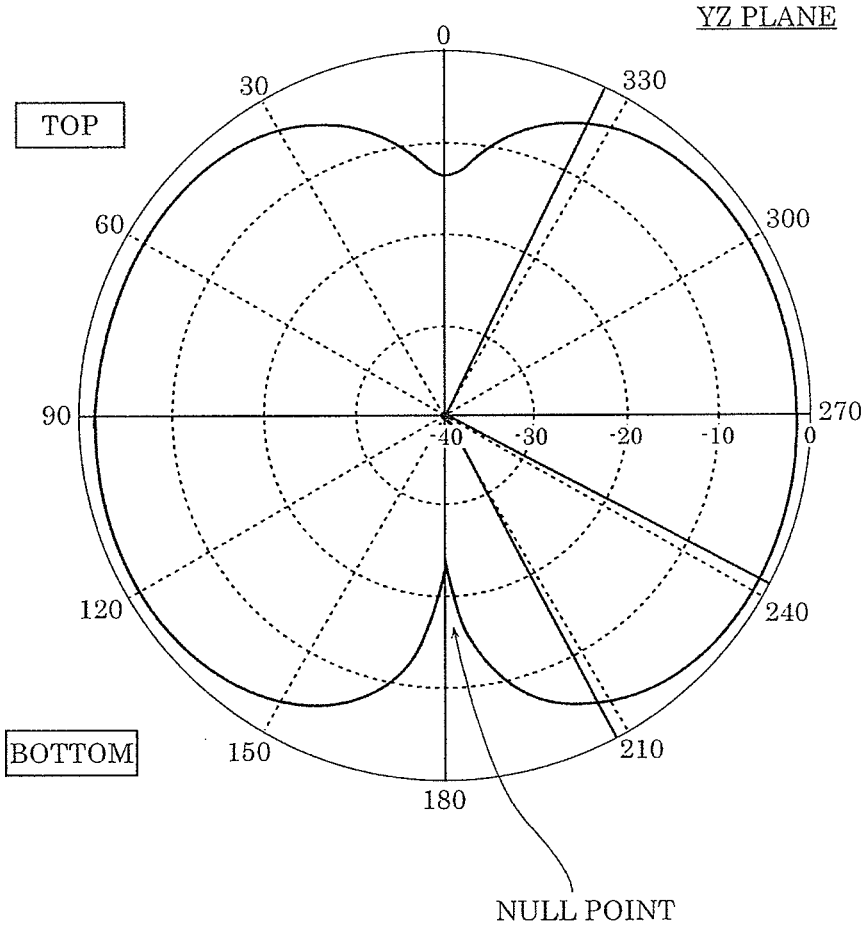
FIG. 18B is a diagram illustrating a radiation pattern in the YZ plane of the metal housing according to a comparative example of Embodiment 3 of the present disclosure.

FIGS. 17A and 17B are diagrams illustrating radiation patterns respectively in the XZ plane (plane parallel to the openings) and the YZ plane (plane perpendicular to the openings) of metal housing 300 illustrated in FIG. 16A. FIGS. 18A and 18B are diagrams illustrating radiation patterns respectively in the XZ plane and the YZ plane of metal housing 320 illustrated in FIG. 16B. FIGS. 17A to 18B illustrate the results of simulating the radiation pattern of the electric wave using metal housings 300 and 320.

The radiation pattern of metal housing 300 has wide directivity on the bottom side in both of the XZ plane and the YZ plane, as illustrated in FIGS. 17A and 17B. Metal housing 300 can radiate the electric wave in a wide area on the bottom side, and receive the electric wave from a wide area on the bottom side.

On the other hand, the radiation pattern of metal housing 320 has null point on the bottom side in both of the XZ plane and the YZ plane, as illustrated in FIGS. 18A and 18B. Thus, in the case where metal housing 320 is used as a slot antenna, the transmission or reception of electric wave is interfered in an area on the bottom side.

As described above, in this embodiment, the radiation pattern of the electric wave radiated from the metal housing can be changed according to the arrangement of openings in the metal housing (i.e. circuit case 220). Here, more excellent radiation pattern characteristics are attained in the case where the opening extends over two or more continuous sides of the polyhedron as in metal housing 300 illustrated in FIG. 16A, than in the case where the opening is formed only on one side of the polyhedron as in metal housing 320 illustrated in FIG. 16B.

[Opening Width of Openings and Radiation Pattern]

Figure 19:
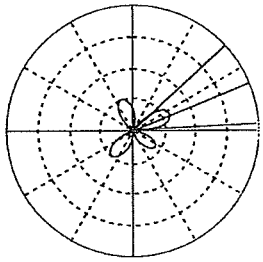
FIG. 19 is a diagram illustrating the relationship between the opening width of openings in the metal housing and the radiation pattern according to Embodiment 3 of the present disclosure.
Figure 19:
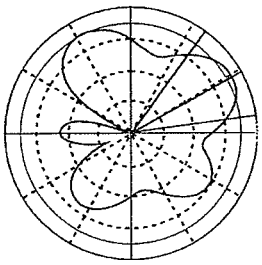
Figure 19:
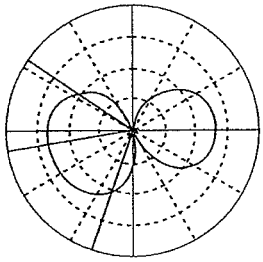
Figure 19:
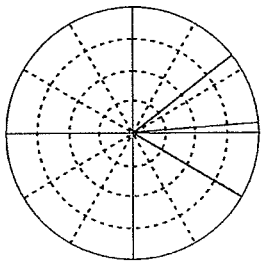
Figure 19:
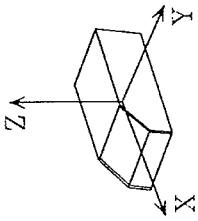

The following describes the relationship between the opening width of openings and the radiation pattern, with reference to FIG. 19. FIG. 19 is a diagram illustrating the relationship between the opening width of openings in the metal housing and the radiation pattern according to this embodiment.

The opening width of an opening is the width of a slit opening in the direction orthogonal to the slit direction. For example, in the case where the opening is substantially rectangular in shape, the opening width is the width in the transverse direction.

FIG. 19 illustrates the radiation pattern with the opening width of 0.5 mm and 1.0 mm in the case where the frequency used is 2.4 GHz. The radiation pattern in each of the XZ plane and the YZ plane is illustrated in FIG. 19.

For example, in the XZ plane, the main lobe strength is −23.4 dB when the opening width is 0.5 mm, and −11.6 dB when the opening width is 1.0 mm. In the YZ plane, on the other hand, the main lobe strength is −16.7 dB when the opening width is 0.5 mm, and −30.5 dB when the opening width is 1.0 mm.

Thus, the radiation pattern differs significantly when the opening width is different. This indicates that constant opening width of openings contributes to more stable wireless communication. For example, the opening width of the openings can be maintained by providing, between the openings, an insulator for maintaining the opening width of the openings.

As an example, opening 223 illustrated in FIG. 14A is formed by combining upper cover 221 and lower cover 222 illustrated in FIG. 15. This raises the possibility that the opening width of opening 223 at the time of or after the combination is not a desired width.

Providing an insulator in opening 223, however, allows the opening width of opening 223 to be maintained. The insulator is made of an insulating resin material as an example. The insulator can be provided in opening 223, for instance, by applying the insulating resin material and curing it by light irradiation or the like.

The insulator provided in opening 223 may be any insulator. For example, an insulating plate member may be pinched in opening 223.

[Distance Between a Plurality of Openings and Radiation Pattern]

The following describes the relationship between the distance between a plurality of openings and the radiation pattern, with reference to FIGS. 20A to 21B.

Figure 20A:
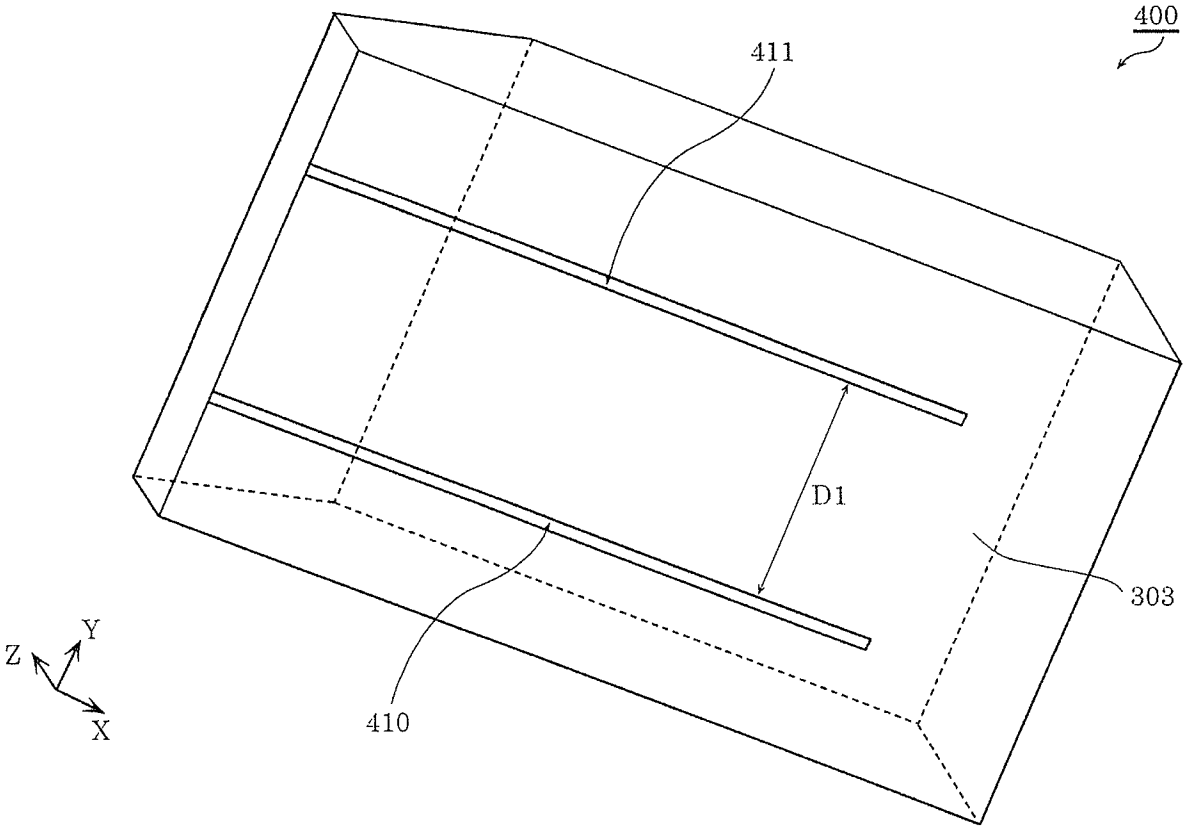
FIG. 20A is a perspective view illustrating the arrangement of a plurality of openings of the metal housing according to Embodiment 3 of the present disclosure.
Figure 20B:
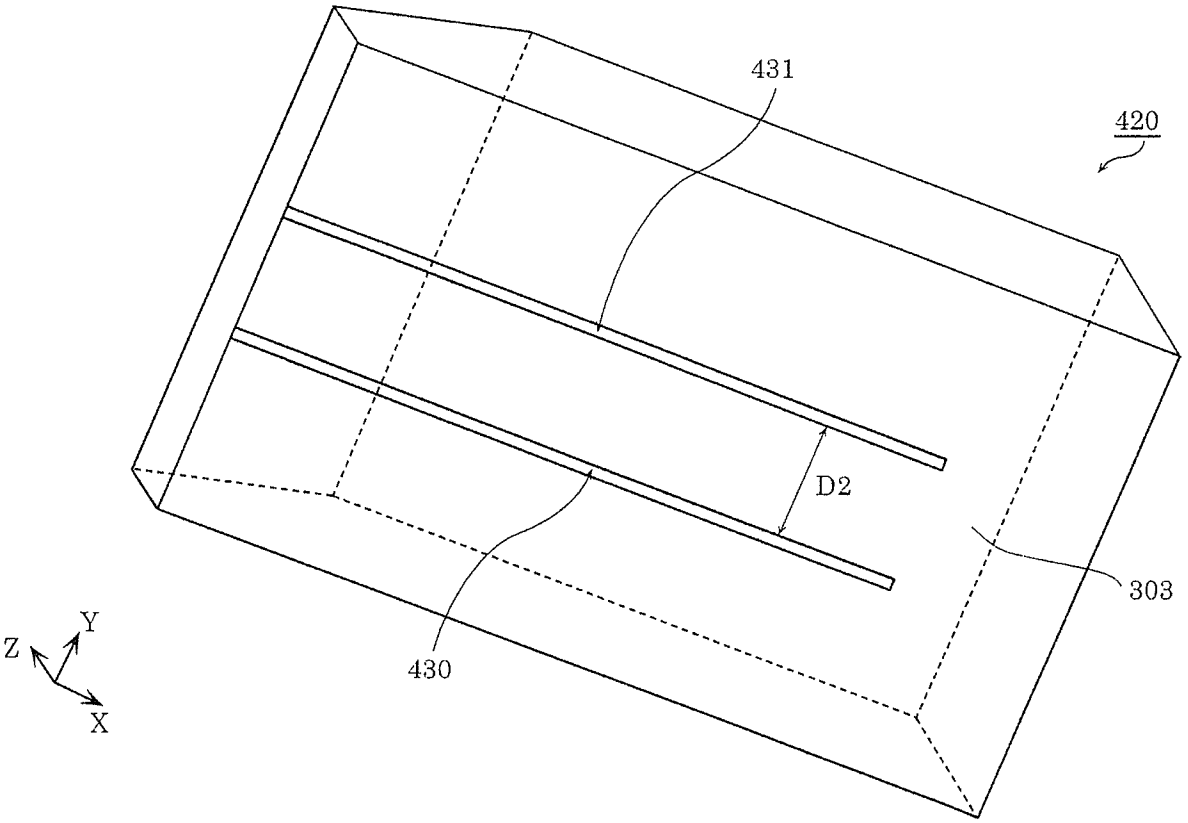
FIG. 20B is a perspective view illustrating the arrangement of a plurality of openings of the metal housing according to a comparative example of Embodiment 3 of the present disclosure.

FIGS. 20A and 20B are each a diagram illustrating the arrangement of a plurality of openings in the metal housing according to this embodiment. In detail, FIGS. 20A and 20B respectively illustrate metal housings 400 and 420 that differ only in the positions of openings from metal housing 300 illustrated in FIG. 16A.

Metal housing 400 illustrated in FIG. 20A has two openings 410 and 411 parallel to each other. Metal housing 420 illustrated in FIG. 20B has two openings 430 and 431 parallel to each other.

Openings 410 and 411 and openings 430 and 431 have the same length and width. In detail, openings 410 and 411 and openings 430 and 431 have a length greater than or equal to substantially half the wavelength corresponding to the wireless signal frequency. Openings 410 and 411 and openings 430 and 431 are formed in surface 303 which corresponds to the bottom surface of a corresponding one of metal housings 400 and 420.

Openings 410 and 411 are at distance D1 from each other, as illustrated in FIG. 20A. Openings 430 and 431 are at distance D2 from each other, as illustrated in FIG. 20B.

Distance D1 is a length greater than or equal to substantially half the wavelength corresponding to the wireless signal frequency. Distance D2 is a length less than substantially half the wavelength corresponding to the wireless signal frequency. Thus, distance D1 is longer than distance D2.

Figure 21A:
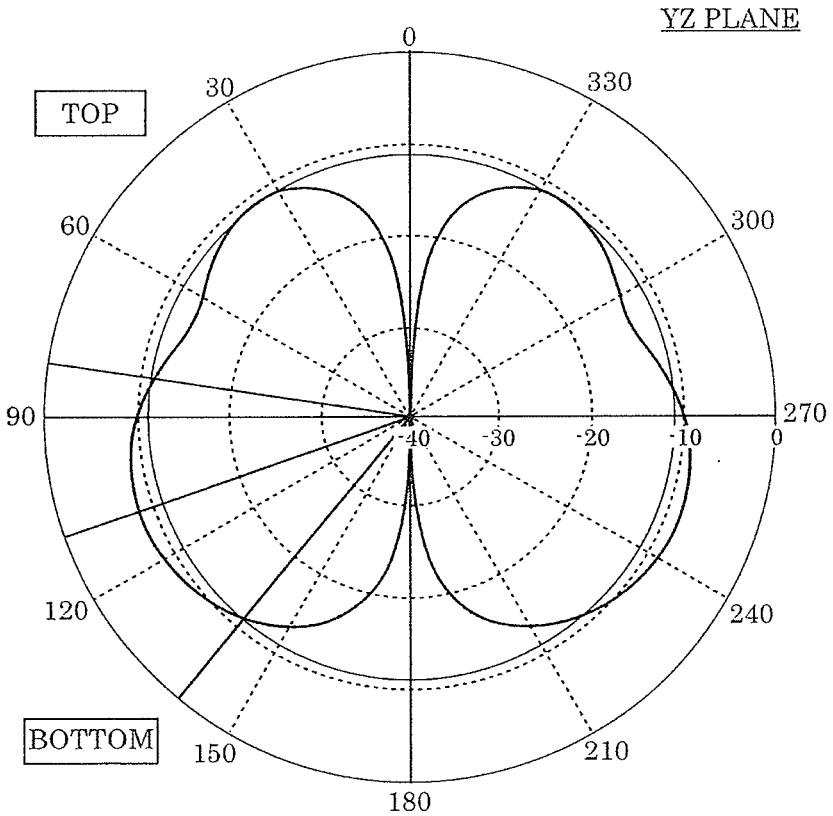
FIG. 21A is a diagram illustrating a radiation pattern in the YZ plane of the metal housing according to Embodiment 3 of the present disclosure.
Figure 21B:
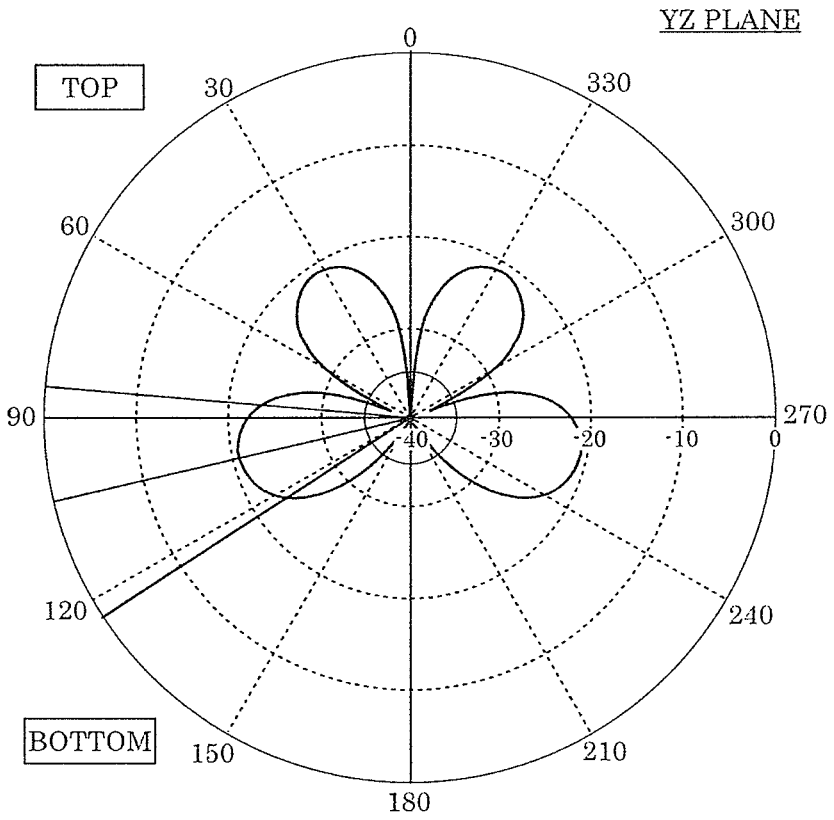
FIG. 21B is a diagram illustrating a radiation pattern in the YZ plane of the metal housing according to a comparative example of Embodiment 3 of the present disclosure.

FIG. 21A is a diagram illustrating the radiation pattern in the YZ plane of metal housing 400 illustrated in FIG. 20A. FIG. 21B is a diagram illustrating the radiation pattern in the YZ plane of metal housing 420 illustrated in FIG. 20B. FIGS. 21A and 21B respectively illustrate the results of simulation using metal housings 400 and 420.

The strength of the electric wave from metal housing 400 is greater than the strength of the electric wave from metal housing 420, as illustrated in FIGS. 21A and 21B. Thus, the electric wave can be efficiently radiated in the case where the distance between two openings arranged in parallel is greater than or equal to substantially half the wavelength corresponding to the wireless signal frequency.

[Conclusion]

As described above, in luminaire 201 according to this embodiment, circuit case 220 (the metal housing) includes two or more metal structures that are combined with each other to create a gap, openings 224 and 225 are each the gap, and a length of openings 224 and 225 is greater than or equal to substantially half a wavelength corresponding to a frequency of the wireless signal.

Thus, the opening of the length greater than or equal to substantially half the wavelength corresponding to the wireless signal frequency is provided. This enables efficient radiation of the electric wave, and improves the communication quality of wireless communication. Moreover, since the gap created by combining the two or more metal structures is used as the opening, there is no need to form the opening in the metal structure. A reduction in the number of manufacturing steps contributes to lower cost.

For example, circuit case 220 is a polyhedron, and openings 224 and 225 are each positioned on a side of the polyhedron.

In this way, the radiation pattern can be changed according to the position of the opening. In other words, the radiation pattern can be changed according to on which side of the polyhedron the opening is provided. Hence, an appropriate radiation pattern can be formed depending on, for example, the installation location of luminaire 201.

For example, opening 225 extends over two or more continuous sides of the polyhedron.

It is desirable to reduce the size of circuit case 220 (metal housing) in which power circuit 60 is contained, in order to reduce the size of luminaire 201. Reducing the size of circuit case 220, however, makes it difficult to form an opening with a necessary length.

In this embodiment, on the other hand, the opening extends over two or more sides of the polyhedron, and so is guaranteed to have a length greater than or equal to substantially half the wavelength corresponding to the wireless signal frequency. This enables efficient radiation of the electric wave, and improves the communication quality of wireless communication.

For example, circuit case 220 has a plurality of openings 225 that are parallel to each other.

This enables efficient radiation of the electric wave, and improves the communication quality of wireless communication.

For example, a distance between the plurality of openings 225 parallel to each other is greater than or equal to substantially half the wavelength corresponding to the frequency of the wireless signal.

Setting the distance between the plurality of openings to be greater than or equal to substantially half the wavelength corresponding to the wireless signal frequency enables efficient radiation of the electric wave, and improves the communication quality of wireless communication.

For example, the luminaire may further include an insulator provided in opening 225 to maintain an opening width of opening 225.

The opening width of the opening can be maintained in this way, as a result of which stable wireless communication can be performed.

Figure 22:
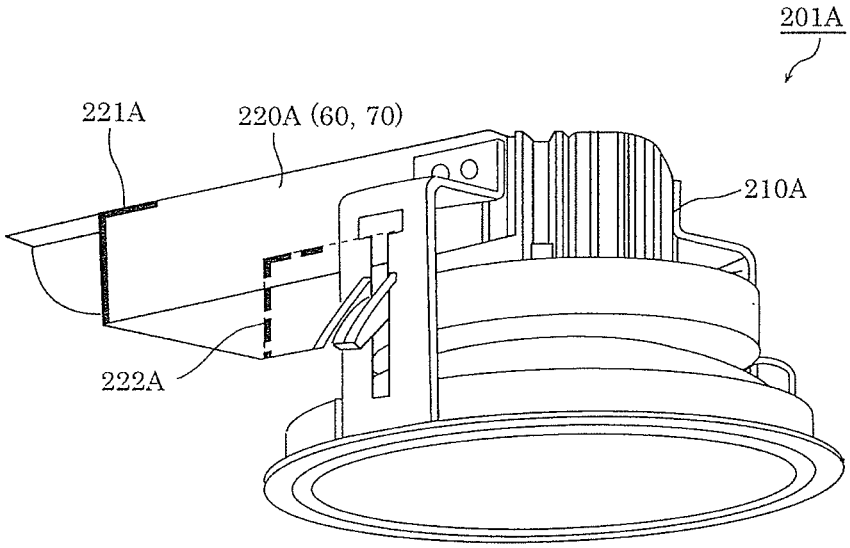
FIG. 22 is an exploded perspective view illustrating another example of the luminaire according to Embodiment 3 of the present disclosure.

Although this embodiment describes the type of downlight in which luminaire body 210 and circuit case 220 are separated physically and connected by cable 261 as illustrated in FIG. 13, this is not a limitation. For example, the type of downlight in which luminaire body 210A and circuit case 220A are connected directly to each other as in luminaire 201A illustrated in FIG. 22 may be used.

Circuit case 220A is a metal housing which is substantially a rectangular parallelepiped, and contains power circuit 60 and wireless module 70 (not illustrated). Circuit case 220A has openings 221A and 222A. The openings are shown by thick lines (thick solid line or thick dotted line) in FIG. 22.

Openings 221A and 222A are provided at an end of substantially rectangular parallelepiped circuit case 220A in the longitudinal direction. Openings 221A and 222A are each a slit opening extending over two sides of circuit case 220A. Openings 221A and 222A are parallel to each other.

With this structure, too, circuit case 220A functions as a slot antenna to enable wireless communication.

Variations of Embodiment 3

Although Embodiment 3 describes an example where the luminaire is a downlight, the luminaire is not limited to such. For example, the luminaire may be a straight-tube LED lamp as described in Embodiment 1.

The following describes variations of Embodiment 3, with reference to FIGS. 23A to 24B.

[Variation 1]

Figure 23A:
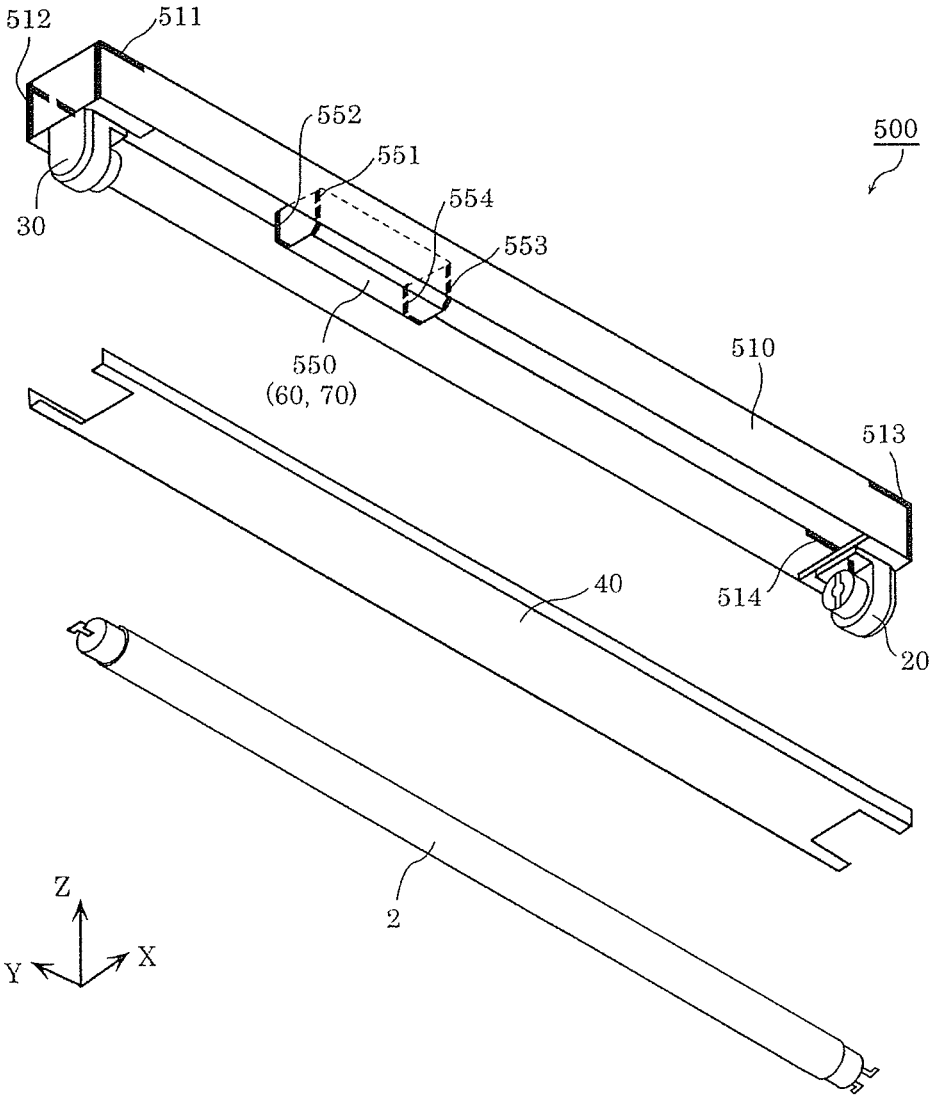
FIG. 23A is an exploded perspective view illustrating a luminaire according to Variation 1 of Embodiment 3 of the present disclosure.

FIG. 23A is an exploded perspective view illustrating luminaire 500 according to Variation 1 of Embodiment 3.

Luminaire 500 illustrated in FIG. 23A differs from luminaire 1 according to Embodiment 1 in that luminaire body 510 and circuit case 550 are included instead of luminaire body 10 and circuit case 50.

Luminaire body 510 has openings 511 to 514, instead of opening 11. In this variation, wireless module 70 is, for example, contained in circuit case 550. Circuit case 550 accordingly has openings 551 to 554. The openings are shown by thick lines (thick solid line or thick dotted line) in FIG. 23A.

Openings 511 and 512 are formed at one end of long luminaire body 510 in the longitudinal direction. Openings 511 and 512 are each an L-shaped slit opening extending over two sides of luminaire body 510. Openings 511 and 512 are parallel to each other.

Openings 513 and 514 are formed at the other end of long luminaire body 510 in the longitudinal direction. Openings 513 and 514 are each an L-shaped slit opening extending over two sides of luminaire body 510. Openings 513 and 514 are parallel to each other.

Openings 551 and 552 are formed at one end of substantially rectangular parallelepiped circuit case 550 in the longitudinal direction. Openings 551 and 552 are each a slit opening extending over two sides of circuit case 550. Openings 551 and 552 are parallel to each other.

Openings 553 and 554 are formed at the other end of substantially rectangular parallelepiped circuit case 550 in the longitudinal direction. Openings 553 and 554 are each a slit opening extending over two sides of circuit case 550. Openings 553 and 554 are parallel to each other.

With this structure, too, circuit case 550 and luminaire body 510 each function as a slot antenna to enable wireless communication.

[Variation 2]

Figure 23B:
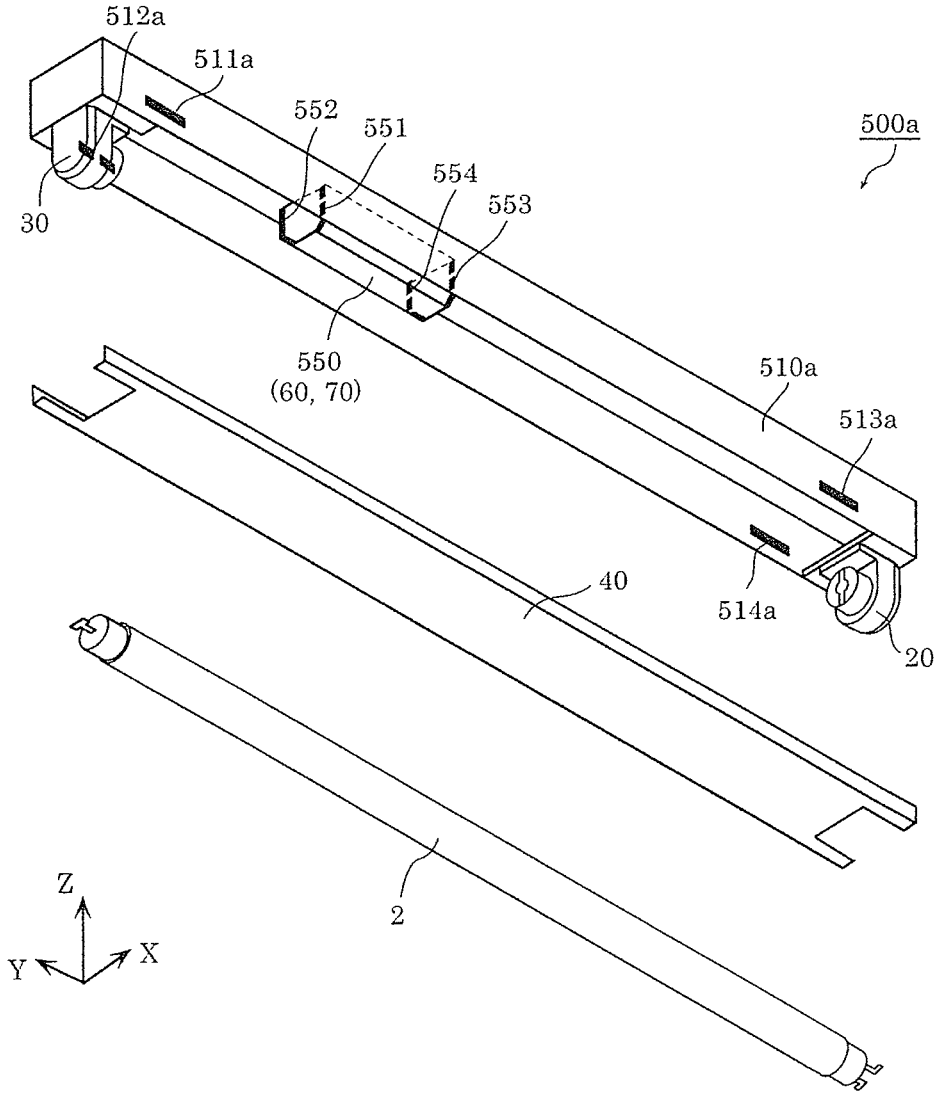
FIG. 23B is an exploded perspective view illustrating a luminaire according to Variation 2 of Embodiment 3 of the present disclosure.

FIG. 23B is an exploded perspective view illustrating luminaire 500*a* according to Variation 2 of Embodiment 3.

Luminaire 500*a* illustrated in FIG. 23B differs from luminaire 1 according to Embodiment 1 in that luminaire body 510*a* and circuit case 550 are included instead of luminaire body 10 and circuit case 50.

Luminaire body 510*a* has openings 511*a* to 514*a*, instead of opening 11. In this variation, wireless module 70 is, for example, contained in circuit case 550. The openings are shown by thick lines (thick solid line or thick dotted line) in FIG. 23B.

Openings 511*a* and 512*a* are formed in side surfaces near one end of long luminaire body 510*a* in the longitudinal direction. Openings 511*a* and 512*a* are each a substantially rectangular slit opening formed in luminaire body 510*a*. Openings 511*a* and 512*a* are parallel to each other.

Openings 513*a* and 514*a* are formed in side surfaces near the other end of long luminaire body 510*a* in the longitudinal direction. Openings 513*a* and 514*a* are each a substantially rectangular slit opening formed in luminaire body 510*a*. Openings 513*a* and 514*a* are parallel to each other.

With this structure, too, circuit case 550 and luminaire body 510*a* each function as a slot antenna to enable wireless communication.

[Variation 3]

Figure 23C:
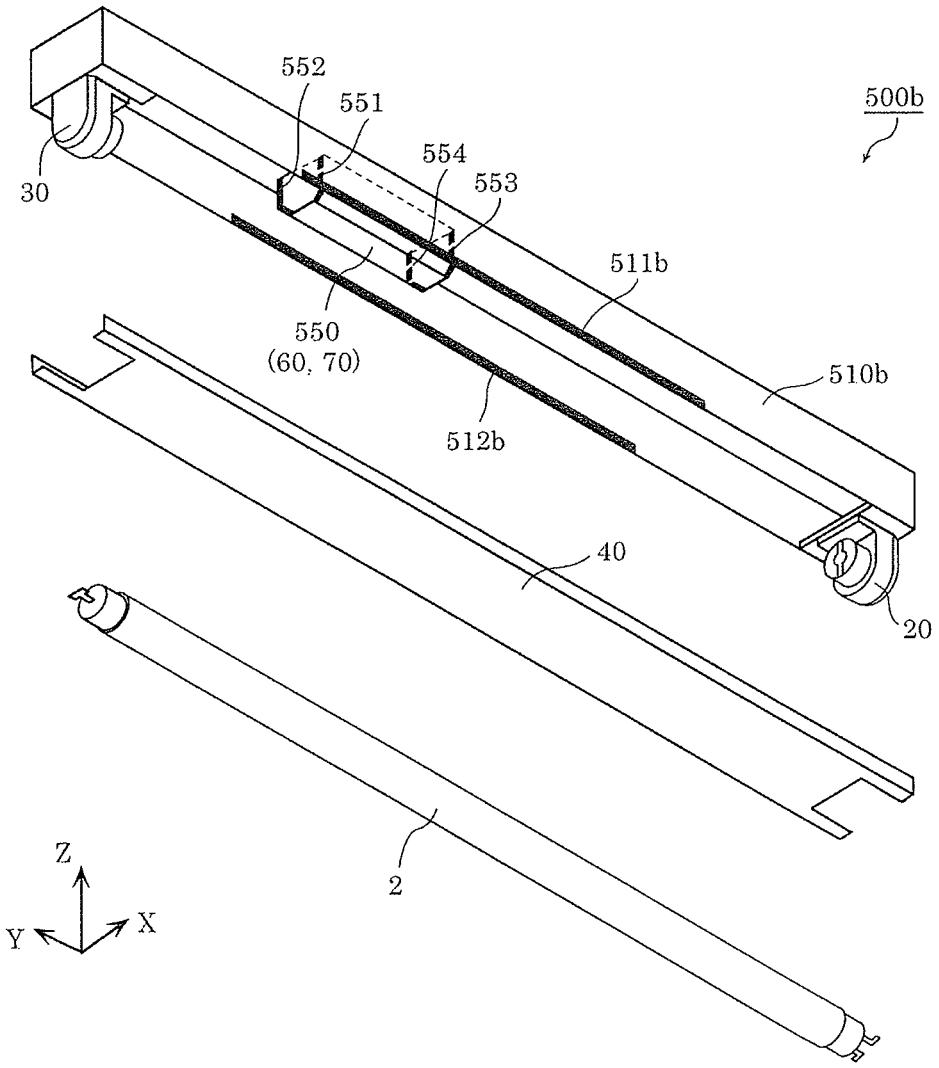
FIG. 23C is an exploded perspective view illustrating a luminaire according to Variation 3 of Embodiment 3 of the present disclosure.

FIG. 23C is an exploded perspective view illustrating luminaire 500*b* according to Variation 3 of Embodiment 3.

Luminaire 500*b* illustrated in FIG. 23C differs from luminaire 1 according to Embodiment 1 in that luminaire body 510*b* and circuit case 550 are included instead of luminaire body 10 and circuit case 50.

Luminaire body 510*b* has openings 511*b* and 512*b*, instead of opening 11. In this variation, wireless module 70 is, for example, contained in circuit case 550. The openings are shown by thick lines (thick solid line or thick dotted line) in FIG. 23C.

Openings 511*b* and 512*b* are formed in side surfaces at the center of long luminaire body 510*b* in the longitudinal direction. Openings 511*b* and 512*b* are each a substantially rectangular slit opening formed on a side of the corresponding side surface of luminaire body 510*b*. Openings 511*b* and 512*b* are parallel to each other.

With this structure, too, circuit case 550 and luminaire body 510*b* each function as a slot antenna to enable wireless communication.

[Variation 4]

Although foregoing Variations 1 to 3 describe an example where the luminaire includes a cylindrical straight-tube LED lamp having a feeding base and a non-feeding base as light source 2, this is not a limitation. This variation describes a luminaire that includes a line light source having a half-cylindrical cover.

Figure 24A:
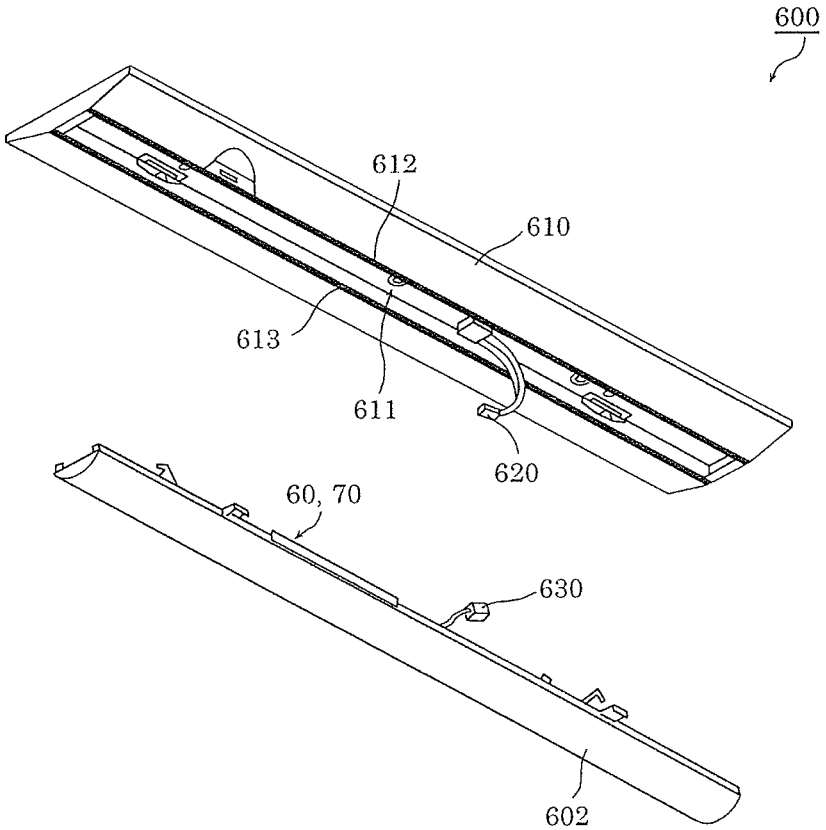
FIG. 24A is an exploded perspective view illustrating a luminaire according to Variation 4 of Embodiment 3 of the present disclosure.

FIG. 24A is an exploded perspective view illustrating luminaire 600 according to Variation 4 of Embodiment 3.

Luminaire 600 includes light source 602, luminaire body 610, connectors 620 and 630, power circuit 60, and wireless module 70.

Light source 602 includes a long LED module and a long translucent cover for covering the LED module. The LED module is, for example, a COB light emitting module in which an LED chip is directly mounted on a board.

Luminaire body 610 is an example of a metal structure. Luminaire body 610 is formed, for example, by bending a plate member made of metal such as aluminum to have opening 611 on the lower side. While luminaire body 510 in Variation 1 and the like is substantially a rectangular parallelepiped, luminaire body 610 in this variation is a flat and long polyhedron. In detail, luminaire body 610 is convex, and has opening 611 in the convex portion.

Luminaire body 610 is connected to connector 620. Connector 620 is a connector for feeding power to light source 602, and is connected to connector 630 to feed power from an external power source (e.g. utility power) to light source 602. In detail, connector 630 is connected to power circuit 60. Power circuit 60 converts power supplied via connectors 620 and 630 and supplies the converted power to light source 602.

Power circuit 60 and wireless module 70 are positioned on the opposite side to the cover of the LED module. Thus, power circuit 60 and wireless module 70 are contained in luminaire body 610 through opening 611 of luminaire body 610 when luminaire body 610 and light source 602 are combined.

Luminaire body 610 has openings 612 and 613.

Openings 612 and 613 are arranged along opening 611 of long luminaire body 610. Openings 612 and 613 are each a substantially rectangular slit opening formed on a side of a side surface of luminaire body 610. Openings 612 and 613 are parallel to each other. Openings 612 and 613 remain open even when luminaire body 610 and light source 602 are combined, and so can radiate the electric wave from wireless module 70.

With this structure, too, luminaire body 610 functions as a slot antenna to enable wireless communication.

[Variation 5]

Although Variation 4 describes an example where luminaire body 610 is convex and light source 602 is outside luminaire body 610, this is not a limitation. This variation describes a luminaire in which light source 602 is contained in luminaire body 610.

Figure 24B:
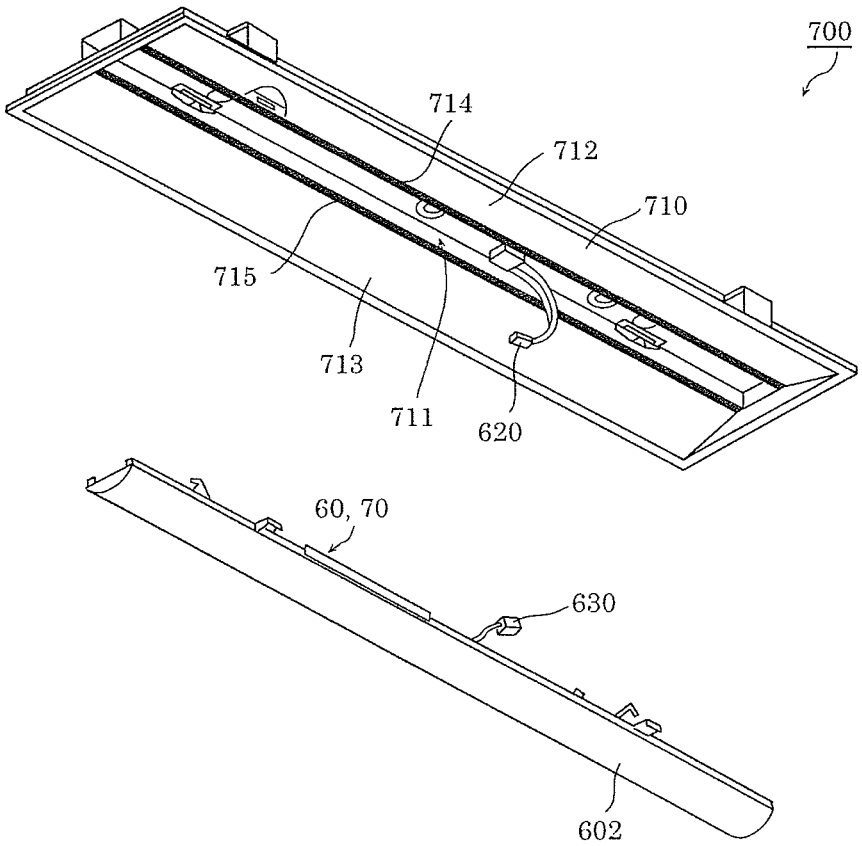
FIG. 24B is an exploded perspective view illustrating a luminaire according to Variation 5 of Embodiment 3 of the present disclosure.

FIG. 24B is an exploded perspective view illustrating luminaire 700 according to Variation 5 of Embodiment 3.

Luminaire 700 includes light source 602, luminaire body 710, connectors 620 and 630, power circuit 60, and wireless module 70.

Luminaire body 710 is an example of a metal structure. Luminaire body 710 is formed, for example, by bending a plate member made of metal such as aluminum to have opening 711 on the lower side. Luminaire body 710 is a flat and long polyhedron. In detail, luminaire body 710 is concave, and has opening 711 in the concave portion. Surfaces 712 and 713 forming the concave portion are, for example, reflection surfaces.

Power circuit 60 and wireless module 70 are contained in luminaire body 710 through opening 711 of luminaire body 710 when luminaire body 710 and light source 602 are combined, as in Variation 4.

Luminaire body 710 has openings 714 and 715.

Openings 714 and 715 are arranged along opening 711 of long luminaire body 710. Openings 714 and 715 are each a substantially rectangular slit opening formed on a side of a corresponding one of surfaces 712 and 713 of luminaire body 710. Openings 714 and 715 are parallel to each other. Openings 714 and 715 remain open even when luminaire body 710 and light source 602 are combined, and so can radiate the electric wave from wireless module 70.

With this structure, too, luminaire body 710 functions as a slot antenna to enable wireless communication.

(Other Variations)

Although the luminaire according to the present disclosure has been described by way of the foregoing embodiments and their variations, the present disclosure is not limited to the foregoing embodiments.

Although the foregoing embodiments describe an example where the antenna is mounted on the printed wiring board, this is not a limitation. The antenna may be a single antenna or the like.

Although the foregoing embodiments describe an example where the metal housing having one or more openings is a polyhedron such as substantially a rectangular parallelepiped, this is not a limitation. The metal housing may have a curved surface. For example, the metal housing may be substantially a cylinder or substantially a truncated cone.

Embodiments 2 and 3 and their variations may be realized independently of Embodiment 1. In detail, Embodiments 2 and 3 and their variations may be realized each as a structure that does not include the matter described in the independent claim representing a superordinate concept. For example, in Embodiments 2 and 3, etc., the antenna and the opening may be arranged without substantial coincidence between the polarization plane of the electric wave most strongly radiated from the antenna and the polarization plane of the electric wave most strongly radiated from the opening.

Other variations obtained by applying various changes conceivable by a person skilled in the art to the embodiments and any combinations of the structural elements and functions in the embodiments without departing from the scope of the present disclosure are also included in the present disclosure.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A luminaire, comprising:

a power circuit that supplies power to a light source;

an antenna that at least one of transmits and receives a wireless signal; and a metal housing that contains the antenna and the power circuit, wherein the metal housing has an opening, the antenna and the opening are arranged to cause a polarization plane of an electric wave most strongly radiated from the antenna and a polarization plane of an electric wave most strongly radiated from the opening to substantially coincide with each other, the antenna is substantially L-shaped, the antenna has a tip portion and a root portion, the root portion being substantially orthogonal to the tip portion and shorter than the tip portion, and the polarization plane of the electric wave most strongly radiated from the antenna is parallel to the root portion.

2. The luminaire according to claim 1, wherein the metal housing is substantially a rectangular parallelepiped, the opening is substantially rectangular in shape, a long side direction of the opening is parallel to a long side direction of the metal housing, and the antenna is positioned with the polarization plane of the electric wave most strongly radiated from the antenna being at an angle of at least ±15° with respect to the long side direction of the opening.

3. The luminaire according to claim 1, wherein the opening is substantially rectangular in shape, and a length of a long side of the opening is greater than or equal to substantially half a wavelength corresponding to a frequency of the wireless signal.

4. The luminaire according to claim 1, wherein the antenna is mounted on a printed wiring board.

5. The luminaire according to claim 1, wherein the opening is a slit opening.

6. The luminaire according to claim 1, wherein the metal housing has one or more openings in a side surface, the one or more openings are each a slit opening, and a length of a first opening along a slit direction is greater than or equal to substantially half a wavelength corresponding to a frequency of the wireless signal, the first opening being at least one of the one or more openings.

7. The luminaire according to claim 6, wherein the metal housing has a plurality of openings in the side surface, and the side surface of the metal housing includes a first plate portion surrounded by the plurality of openings;

a second plate portion that is a part outside the plurality of openings; and a connecting portion that is a part between an end of one of the plurality of openings and an end of another one of the plurality of openings, and connects the first plate portion and the second plate portion.

8. The luminaire according to claim 7, wherein the plurality of openings include a plurality of first openings each of which is the first opening, and the plurality of first openings have parts substantially parallel to each other.

9. The luminaire according to claim 7, wherein the plurality of openings include a second opening different from the first opening, and a length of the second opening along a slit direction is less than or equal to half the length of the first opening along the slit direction.

10. The luminaire according to claim 7, wherein the metal housing has a plurality of opening groups in the side surface, each of the plurality of opening groups including the first plate portion, the connecting portion, and the plurality of openings.

11. The luminaire according to claim 7, wherein the first plate portion, the second plate portion, and the connecting portion have substantially a same surface color.

12. The luminaire according to claim 6, further comprising:

an insulator provided in the one or more openings.

13. The luminaire according to claim 1, wherein the metal housing includes two or more metal structures that are combined with each other to create a gap, the opening is the gap, and a length of the opening is greater than or equal to substantially half a wavelength corresponding to a frequency of the wireless signal.

14. The luminaire according to claim 13, wherein the metal housing is a polyhedron, and the opening is positioned on a side of the polyhedron.

15. The luminaire according to claim 14, wherein the opening extends over two or more continuous sides of the polyhedron.

16. The luminaire according to claim 13, wherein the metal housing has a plurality of openings that are parallel to each other.

17. The luminaire according to claim 16, wherein a distance between the plurality of openings parallel to each other is greater than or equal to substantially half the wavelength corresponding to the frequency of the wireless signal.

18. The luminaire according to claim 13, further comprising:

an insulator provided in the opening to maintain an opening width of the opening.

* * * * *